US007913779B2

(12) United States Patent
Choe et al.

(10) Patent No.: US 7,913,779 B2
(45) Date of Patent: Mar. 29, 2011

(54) EARTH-BORING ROTARY DRILL BITS INCLUDING BIT BODIES HAVING BORON CARBIDE PARTICLES IN ALUMINUM OR ALUMINUM-BASED ALLOY MATRIX MATERIALS, AND METHODS FOR FORMING SUCH BITS

(75) Inventors: Heeman Choe, The Woodlands, TX (US); John H. Stevens, Spring, TX (US); James C. Westhoff, The Woodlands, TX (US); Jimmy W. Eason, The Woodlands, TX (US); James L. Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 485 days.

(21) Appl. No.: 11/540,912

(22) Filed: Sep. 29, 2006

(65) Prior Publication Data

US 2007/0102200 A1 May 10, 2007

Related U.S. Application Data

(63) Continuation-in-part of application No. 11/271,153, filed on Nov. 10, 2005, and a continuation-in-part of application No. 11/272,439, filed on Nov. 10, 2005.

(51) Int. Cl.
*E21B 10/36* (2006.01)

(52) U.S. Cl. ..... 175/374; 175/425

(58) Field of Classification Search ..... 175/374, 175/425

See application file for complete search history.

(56) References Cited

U.S. PATENT DOCUMENTS

| | | | |
|---|---|---|---|
| 2,507,439 | A | 5/1950 | Goolsbee |
| 2,819,958 | A | 1/1958 | Abkowitz et al. |
| 2,819,959 | A | 1/1958 | Abkowitz et al. |
| 2,906,654 | A | 9/1959 | Abkowitz |

(Continued)

FOREIGN PATENT DOCUMENTS

| | | |
|---|---|---|
| AU | 695583 | 2/1998 |

(Continued)

OTHER PUBLICATIONS

International Search Report for PCT/US2007/021070, mailed Feb. 6, 2008.

(Continued)

*Primary Examiner* — William P Neuder
(74) *Attorney, Agent, or Firm* — TraskBritt

(57) ABSTRACT

Rotary drill bits for drilling subterranean formations include a bit body and at least one cutting structure disposed on a face thereof. The bit body includes a crown region comprising a particle-matrix composite material that includes a plurality of boron carbide particles dispersed throughout an aluminum or aluminum-based alloy matrix material. In some embodiments, the matrix material may include a continuous solid solution phase and a discontinuous precipitate phase. Methods of manufacturing rotary drill bits for drilling subterranean formations include infiltrating a plurality of boron carbide particles with a molten aluminum or aluminum-based material. In additional methods, a green powder component is provided that includes a plurality of particles each comprising boron carbide and a plurality of particles each comprising aluminum or an aluminum-based alloy material. The green powder component is at least partially sintered to provide a bit body, and a shank is attached to the bit body.

18 Claims, 12 Drawing Sheets

U.S. PATENT DOCUMENTS 3,368,881 A 2/1968 Abkowitz et al.
3,471,921 A 10/1969 Feenstra
3,660,050 A 5/1972 Iler et al.
3,757,879 A 9/1973 Wilder et al.
3,987,859 A 10/1976 Lichte
4,017,480 A 4/1977 Baum
4,047,828 A 9/1977 Makely
4,094,709 A 6/1978 Rozmus
4,128,136 A 12/1978 Generoux
4,221,270 A 9/1980 Vezirian
4,229,638 A 10/1980 Lichte
4,233,720 A 11/1980 Rozmus
4,252,202 A 2/1981 Purser, Sr.
4,255,165 A 3/1981 Dennis et al.
4,306,139 A 12/1981 Shinozaki et al.
4,341,557 A 7/1982 Lizenby
4,389,952 A 6/1983 Dreier et al.
4,398,952 A 8/1983 Drake
4,499,048 A 2/1985 Hanejko
4,499,795 A 2/1985 Radtke
4,499,958 A 2/1985 Radtke et al.
4,526,748 A 7/1985 Rozmus
4,547,337 A 10/1985 Rozmus
4,552,232 A 11/1985 Frear
4,554,130 A 11/1985 Ecer
4,562,990 A 1/1986 Rose
4,596,694 A 6/1986 Rozmus
4,597,730 A 7/1986 Rozmus
4,620,600 A 11/1986 Persson
4,656,002 A 4/1987 Lizenby et al.
4,667,756 A 5/1987 King et al.
4,686,080 A 8/1987 Hara et al.
4,694,919 A 9/1987 Barr
4,743,515 A 5/1988 Fischer et al.
4,744,943 A 5/1988 Timm
4,809,903 A 3/1989 Eylon et al.
4,838,366 A 6/1989 Jones
4,871,377 A 10/1989 Frushour
4,919,013 A 4/1990 Smith et al.
4,923,512 A 5/1990 Timm et al.
4,956,012 A 9/1990 Jacobs et al.
4,968,348 A 11/1990 Abkowitz et al.
5,000,273 A 3/1991 Horton et al.
5,030,598 A 7/1991 Hsieh
5,032,352 A 7/1991 Meeks et al.
5,049,450 A 9/1991 Dorfman et al.
5,090,491 A 2/1992 Tibbitts et al.
5,101,692 A 4/1992 Simpson
5,150,636 A 9/1992 Hill
5,161,898 A 11/1992 Drake
5,232,522 A 8/1993 Doktycz et al.
5,281,260 A 1/1994 Kumar et al.
5,286,685 A 2/1994 Schoennahl et al.
5,348,806 A 9/1994 Kojo et al.
5,439,068 A 8/1995 Huffstutler et al.
5,443,337 A 8/1995 Katayama
5,482,670 A 1/1996 Hong
5,484,468 A 1/1996 Ostlund et al.
5,506,055 A 4/1996 Dorfman et al.
5,543,235 A 8/1996 Mirchandani et al.
5,560,440 A 10/1996 Tibbitts
5,593,474 A 1/1997 Keshavan et al.
5,611,251 A 3/1997 Katayama
5,612,264 A 3/1997 Nilsson et al.
5,641,251 A 6/1997 Leins et al.
5,641,921 A 6/1997 Dennis et al.
5,662,183 A 9/1997 Fang
5,677,042 A 10/1997 Massa et al.
5,679,445 A 10/1997 Massa et al.
5,697,046 A 12/1997 Conley
5,732,783 A 3/1998 Truax et al.
5,733,649 A 3/1998 Kelley et al.
5,733,664 A 3/1998 Kelley et al.
5,753,160 A 5/1998 Takeuchi et al.
5,765,095 A 6/1998 Flak et al.
5,776,593 A 7/1998 Massa et al.
5,778,301 A 7/1998 Hong
5,789,686 A 8/1998 Massa et al.
5,792,403 A 8/1998 Massa et al.
5,806,934 A 9/1998 Massa et al.
5,829,539 A 11/1998 Newton et al.
5,830,256 A 11/1998 Northrop et al.
5,856,626 A 1/1999 Fischer et al.
5,865,571 A 2/1999 Tankala et al.
5,880,382 A 3/1999 Fang et al.
5,897,830 A 4/1999 Abkowitz et al.
5,957,006 A 9/1999 Smith
5,963,775 A 10/1999 Fang
5,980,602 A * 11/1999 Carden ..... 75/236
6,029,544 A 2/2000 Katayama
6,045,750 A 4/2000 Drake et al.
6,051,171 A 4/2000 Takeuchi et al.
6,063,333 A 5/2000 Dennis
6,086,980 A 7/2000 Foster et al.
6,089,123 A 7/2000 Chow et al.
6,099,664 A 8/2000 Davies et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,287 B1 4/2001 Waldenstrom
6,220,117 B1 4/2001 Butcher
6,227,188 B1 5/2001 Tankala et al.
6,228,139 B1 5/2001 Oskarsson
6,241,036 B1 6/2001 Lovato et al.
6,254,658 B1 7/2001 Taniuchi et al.
6,287,360 B1 9/2001 Kembaiyan et al.
6,290,438 B1 9/2001 Papajewski
6,293,986 B1 9/2001 Rodiger et al.
6,348,110 B1 2/2002 Evans
6,375,706 B2 4/2002 Kembaiyan et al.
6,454,025 B1 9/2002 Runquist et al.
6,454,028 B1 9/2002 Evans
6,454,030 B1 9/2002 Findley et al.
6,458,471 B2 10/2002 Lovato et al.
6,500,226 B1 12/2002 Dennis
6,511,265 B1 1/2003 Keller et al.
6,576,182 B1 6/2003 Ravagni et al.
6,589,640 B2 7/2003 Griffin et al.
6,599,467 B1 7/2003 Yamaguchi et al.
6,607,693 B1 8/2003 Saito et al.
6,655,481 B2 12/2003 Findley et al.
6,685,880 B2 2/2004 Engstrom et al.
6,742,611 B1 6/2004 Illerhaus et al.
6,756,009 B2 6/2004 Sim et al.
6,849,231 B2 2/2005 Kojima et al.
6,918,942 B2 7/2005 Hatta et al.
7,044,243 B2 5/2006 Kembaiyan et al.
7,048,081 B2 5/2006 Smith et al.
2003/0010409 A1 1/2003 Kunze et al.
2004/0013558 A1 1/2004 Kondoh et al.
2004/0060742 A1 4/2004 Kembaiyan et al.
2004/0243241 A1 12/2004 Istephanous et al.
2004/0245024 A1 12/2004 Kembaiyan
2005/0072496 A1 4/2005 Hwang et al.
2005/0117984 A1 6/2005 Eason et al.
2005/0126334 A1 6/2005 Mirchandani
2005/0211474 A1 9/2005 Nguyen et al.
2005/0211475 A1 9/2005 Mirchandani et al.
2005/0247491 A1 11/2005 Mirchandani et al.
2005/0268746 A1 12/2005 Abkowitz et al.
2006/0013719 A1 * 1/2006 Ichikawa et al. ..... 419/29
2006/0016521 A1 1/2006 Hanusiak et al.
2006/0043648 A1 3/2006 Takeuchi et al.
2006/0057017 A1 3/2006 Woodfield et al.
2006/0131081 A1 6/2006 Mirchandani et al.
2007/0042217 A1 2/2007 Fang et al.

FOREIGN PATENT DOCUMENTS

CA 2212197 10/2000
EP 0 453 428 A1 10/1991
EP 0 995 876 A2 4/2000
EP 1 244 531 B1 10/2002
GB 516474 1/1940
GB 945227 12/1963
GB 2203774 A 10/1988
GB 2 385 350 A 8/2003

| | | | |
|---|---|---|---|
| GB | 2 393 449 | A | 3/2004 |
| JP | 10 219385 | A | 8/1998 |
| WO | WO 03/049889 | A2 | 6/2003 |
| WO | 2006032982 | A1 | 3/2006 |

OTHER PUBLICATIONS

PCT International Search Report for counterpart PCT International Application No. PCT/US2007/023275, mailed Apr. 11, 2008.
U.S. Appl. No. 60/566,063, filed Apr. 28, 2004, entitled "Body Materials for Earth Boring Bits" to Mirchandani et al.
Alman, D.E., et al., The Abrasive Wear of Sintered Titanium Matrix-Ceramic Particle Reinforced Composites, WEAR, 225-229 (1999), pp. 629-639.
Boron Carbide Nozzles and Inserts, Seven Stars International webpage http://www.concentric.net/~ctkang/nozzle.shtml, printed Sep. 7, 2006.
Choe, Heeman, et al., Effect of Tungsten Additions on the Mechanical Properties of Ti-6A1-4V, Material Science and Engineering, A 396 2005, pp. 99-106, Elsevier Inc.
Daimond Innovations, Composite Diamond Coatings, Superhard Protection of Wear Parts New Coating and Service Parts from Diamond Innovations brochure, 2004.
Gale, W.F., et al., Smithells Metals Reference Book, Eighth Edition, 2003, p. 2,117, Elsivier Butterworth Heinemann.
Heat Treating of Titanium and Titanium Alloys, Key to Metals website article, www.key-to-metals.com (no date).
Miserez, A., et al. Particle Reinforced Metals of High Ceramic Content, Material Science and Engineering A 387-389 (2004), pp. 822-831, Elsevier.
Warrier, S.G., et al., Infiltration of Titanium Alloy-Matrix Composites, Journal of Materials Science Letters, 12 (1993), pp. 865-868, Chapman & Hall.
U.S. Appl. No. 11/271,153, filed Nov. 10, 2005, entitled "Earth-Boring Rotary Drill Bits and Methods of Forming Earth-Boring Rotary Drill Bits.".
U.S. Appl. No. 11/272,439, filed Nov. 10, 2005, entitled "Earth-Boring Rotary Drill Bits and Methods of Manufacturing Earth-Boring Rotary Drill Bits Having Particle-Matrix Composite Bit Bodies.".
Reed, James S., Principles of Ceramics Processing, Second Edition, 1995, pp. 215-227, John Wiley & Sons, Inc.
U.S. Appl. No. 11/593,437, filed Nov. 6, 2006, entitled "Earth-Boring Rotary Drill Bits Including Bit Bodies Comprising Reinforced Titanium or Titanium-Based Alloy Matrix Materials, and Methods For Forming Such Bits" to Choe et al.
US 4,966,627, 10/1990, Keshavan et al. (withdrawn)

* cited by examiner

EARTH-BORING ROTARY DRILL BITS INCLUDING BIT BODIES HAVING BORON CARBIDE PARTICLES IN ALUMINUM OR ALUMINUM-BASED ALLOY MATRIX MATERIALS, AND METHODS FOR FORMING SUCH BITS

CROSS-REFERENCE TO RELATED APPLICATIONS

This application is a continuation-in-part of application Ser. No. 11/271,153, filed Nov. 10, 2005, now U.S. Pat. No. 7,802,495, issued Sep. 28, 2010, the disclosure of which is incorporated herein in its entirety by this reference. This application is also a continuation-in-part of application Ser. No. 11/272,439, filed Nov. 10, 2005, now U.S. Pat. No. 7,776,256, issued Aug. 17, 2010, the disclosure of which is also incorporated herein in its entirety by this reference.

BACKGROUND OF THE INVENTION

1. Field of the Invention

The present invention generally relates to earth-boring rotary drill bits, and to methods of manufacturing such earth-boring rotary drill bits. More particularly, the present invention generally relates to earth-boring rotary drill bits that include a bit body having at least a portion thereof substantially formed of a particle-matrix composite material, and to methods of manufacturing such earth-boring rotary drill bits.

2. State of the Art

Rotary drill bits are commonly used for drilling bore holes, or well bores, in earth formations. Rotary drill bits include two primary configurations. One configuration is the roller cone bit, which conventionally includes three roller cones mounted on support legs that extend from a bit body. Each roller cone is configured to spin or rotate on a support leg. Teeth are provided on the outer surfaces of each roller cone for cutting rock and other earth formations. The teeth often are coated with an abrasive, hard ("hardfacing") material. Such materials often include tungsten carbide particles dispersed throughout a metal alloy matrix material. Alternatively, receptacles are provided on the outer surfaces of each roller cone into which hard metal inserts are secured to form the cutting elements. In some instances, these inserts comprise a superabrasive material formed on and bonded to a metallic substrate. The roller cone drill bit may be placed in a bore hole such that the roller cones abut against the earth formation to be drilled. As the drill bit is rotated under applied weight on bit, the roller cones roll across the surface of the formation, and the teeth crush the underlying formation.

A second primary configuration of a rotary drill bit is the fixed-cutter bit (often referred to as a "drag" bit), which conventionally includes a plurality of cutting elements secured to a face region of a bit body. Generally, the cutting elements of a fixed-cutter type drill bit have either a disk shape or a substantially cylindrical shape. A hard, superabrasive material, such as mutually bonded particles of polycrystalline diamond, may be provided on a substantially circular end surface of each cutting element to provide a cutting surface. Such cutting elements are often referred to as "polycrystalline diamond compact" (PDC) cutters. The cutting elements may be fabricated separately from the bit body and are secured within pockets formed in the outer surface of the bit body. A bonding material such as an adhesive or a braze alloy may be used to secure the cutting elements to the bit body. The fixed-cutter drill bit may be placed in a bore hole such that the cutting elements abut against the earth formation to be drilled. As the drill bit is rotated, the cutting elements scrape across and shear away the surface of the underlying formation.

The bit body of a rotary drill bit of either primary configuration may be secured, as is conventional, to a hardened steel shank having an American Petroleum Institute (API) threaded pin for attaching the drill bit to a drill string. The drill string includes tubular pipe and equipment segments coupled end to end between the drill bit and other drilling equipment at the surface. Equipment such as a rotary table or top drive may be used for rotating the drill string and the drill bit within the bore hole. Alternatively, the shank of the drill bit may be coupled directly to the drive shaft of a down-hole motor, which then may be used to rotate the drill bit.

The bit body of a rotary drill bit may be formed from steel. Alternatively, the bit body may be formed from a particle-matrix composite material. Such particle-matrix composite materials conventionally include hard tungsten carbide particles randomly dispersed throughout a copper or copper-based alloy matrix material (often referred to as a "binder" material). Such bit bodies conventionally are formed by embedding a steel blank in tungsten carbide particulate material within a mold, and infiltrating the particulate tungsten carbide material with molten copper or copper-based alloy material. Drill bits that have bit bodies formed from such particle-matrix composite materials may exhibit increased erosion and wear resistance, but lower strength and toughness, relative to drill bits having steel bit bodies.

As subterranean drilling conditions and requirements become ever more rigorous, there arises a need in the art for novel particle-matrix composite materials for use in bit bodies of rotary drill bits that exhibit enhanced physical properties and that may be used to improve the performance of earth-boring rotary drill bits.

BRIEF SUMMARY OF THE INVENTION

In one embodiment, the present invention includes rotary drill bits for drilling subterranean formations. The drill bits include a bit body and at least one cutting structure disposed on a face of the bit body. The bit body includes a particle-matrix composite material comprising a plurality of boron carbide particles in an aluminum or an aluminum-based alloy matrix material. In some embodiments of the invention, the matrix material may include a continuous solid solution phase and a discontinuous precipitate phase.

In another embodiment, the present invention includes methods of forming earth-boring rotary drill bits in which boron carbide particles are infiltrated with a molten aluminum or a molten aluminum-based alloy material.

In yet another embodiment, the present invention includes methods of forming earth-boring rotary drill bits in which a green powder component is provided that includes a plurality of particles each comprising boron carbide and a plurality of particles each comprising aluminum or an aluminum-based alloy material. The green powder component is at least partially sintered to provide a bit body, and a shank is attached to the bit body.

The features, advantages, and additional aspects of the present invention will be apparent to those skilled in the art from a consideration of the following detailed description considered in combination with the accompanying drawings.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

The illustrations presented herein are not meant to be actual views of any particular material, apparatus, or method, but are merely idealized representations which are employed to describe the present invention. Additionally, elements common between figures may retain the same numerical designation.

The term "green" as used herein means unsintered.

The term "green bit body" as used herein means an unsintered structure comprising a plurality of discrete particles held together by a binder material, the structure having a size and shape allowing the formation of a bit body suitable for use in an earth-boring drill bit from the structure by subsequent manufacturing processes including, but not limited to, machining and densification.

The term "brown" as used herein means partially sintered.

The term "brown bit body" as used herein means a partially sintered structure comprising a plurality of particles, at least some of which have partially grown together to provide at least partial bonding between adjacent particles, the structure having a size and shape allowing the formation of a bit body suitable for use in an earth-boring drill bit from the structure by subsequent manufacturing processes including, but not limited to, machining and further densification. Brown bit bodies may be formed by, for example, partially sintering a green bit body.

As used herein, the term "material composition" means the chemical composition and microstructure of a material. In other words, materials having the same chemical composition but a different microstructure are considered to have different material compositions.

The term "sintering" as used herein means densification of a particulate component involving removal of at least a portion of the pores between the starting particles (accompanied by shrinkage) combined with coalescence and bonding between adjacent particles.

Figure 1:
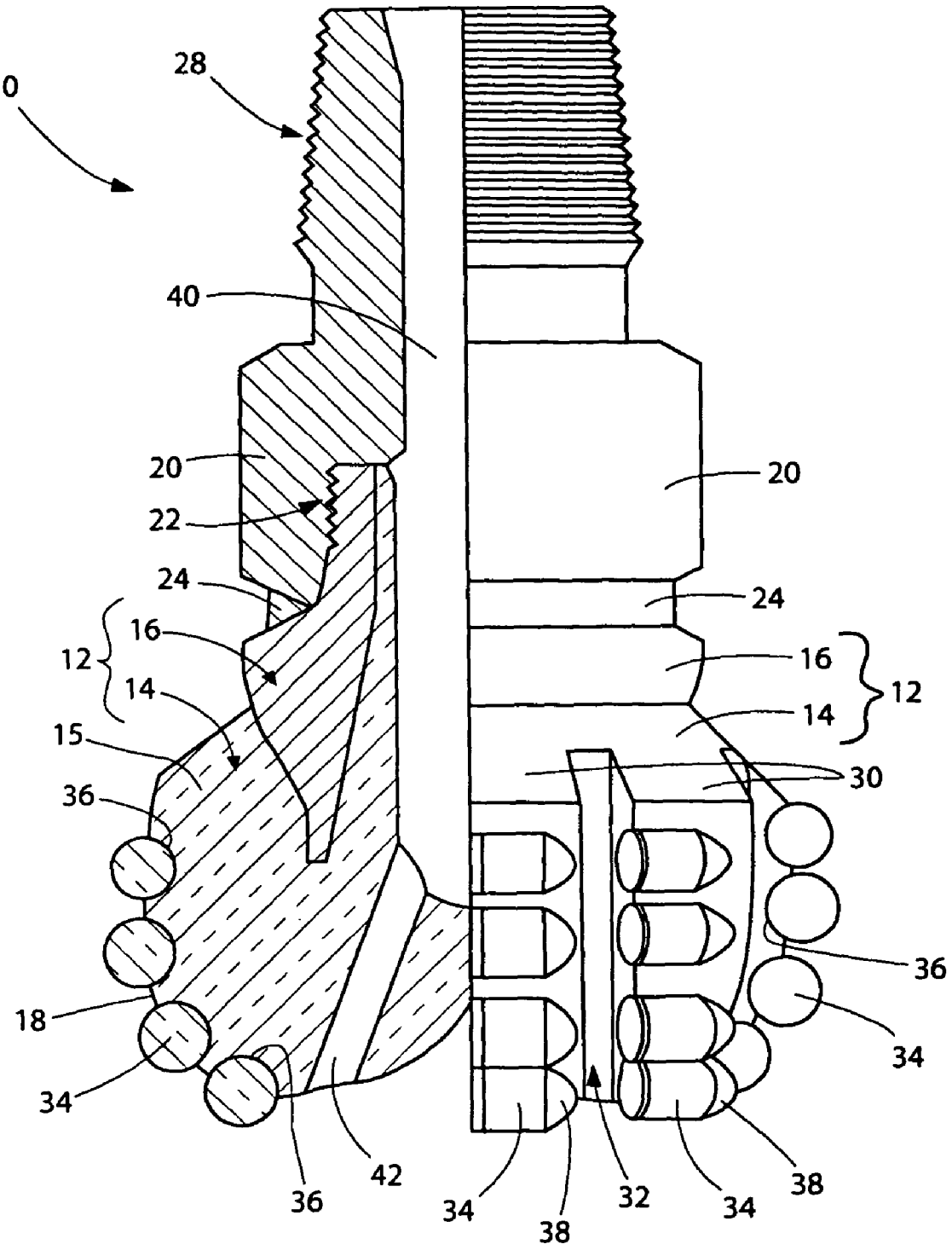
FIG. 1 is a partial cross-sectional side view of an earth-boring rotary drill bit that embodies teachings of the present invention and includes a bit body comprising a particle-matrix composite material.

An earth-boring rotary drill bit 10 that embodies teachings of the present invention is shown in FIG. 1. The drill bit 10 includes a bit body 12 comprising a particle-matrix composite material 15 that includes a plurality of boron carbide particles dispersed throughout an aluminum or an aluminum-based alloy matrix material. By way of example and not limitation, the bit body 12 may include a crown region 14 and a metal blank 16. The crown region 14 may be predominantly comprised of the particle-matrix composite material 15, as shown in FIG. 1. The metal blank 16 may comprise a metal or metal alloy, and may be configured for securing the crown region 14 of the bit body 12 to a metal shank 20 that is configured for securing the drill bit 10 to a drill string. The metal blank 16 may be secured to the crown region 14 during fabrication of the crown region 14, as discussed in further detail below.

Figure 2:
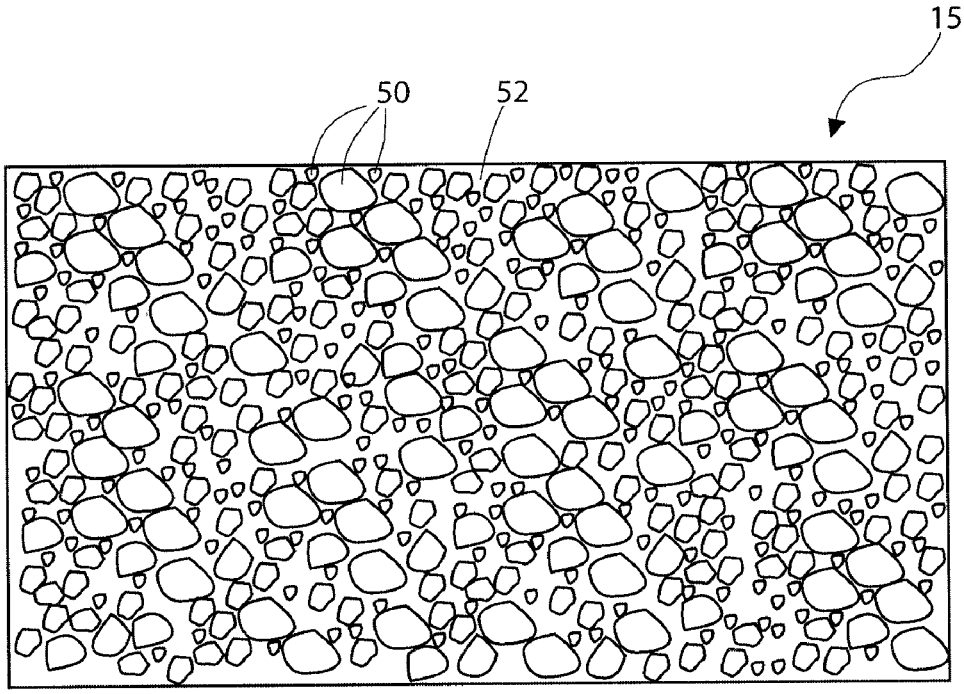
FIG. 2 is an illustration representing one example of how a microstructure of the particle-matrix composite material of the bit body of the drill bit shown in FIG. 1 may appear in a micrograph at a first level of magnification.

FIG. 2 is an illustration providing one example of how the microstructure of the particle-matrix composite material 15 may appear in a magnified micrograph acquired using, for example, an optical microscope, a scanning electron microscope (SEM), or other instrument capable of acquiring or generating a magnified image of the particle-matrix composite material 15. As shown in FIG. 2, the particle-matrix composite material 15 may include a plurality of boron carbide ($B_4C$) particles dispersed throughout an aluminum or an aluminum-based alloy matrix material 52. By way of example and not limitation, the boron carbide particles 50 may comprise between about 40% and about 60% by weight of the particle-matrix composite material 15, and the matrix material 52 may comprise between about 60% and about 40% by weight of the particle-matrix composite material 15.

As shown in FIG. 2, in some embodiments, the boron carbide particles 50 may have different sizes. In some embodiments, the plurality of boron carbide particles 50 may include a multi-modal particle size distribution (e.g., bi-modal, tri-modal, tetra-modal, penta-modal, etc.), while in other embodiments, the boron carbide particles 50 may have a substantially uniform particle size. By way of example and not limitation, the plurality of boron carbide particles 50 may include a plurality of −20 ASTM (American Society for Testing and Materials) Mesh boron carbide particles. As used herein, the phrase "−20 ASTM mesh particles" means particles that pass through an ASTM No. 20 U.S.A. standard testing sieve as defined in ASTM Specification E11-04, which is entitled Standard Specification for Wire Cloth and Sieves for Testing Purposes.

In some embodiments of the present invention, the bulk matrix material 52 may include at least 75% by weight aluminum, and at least trace amounts of at least one of copper, iron, lithium, magnesium, manganese, nickel, scandium, silicon, tin, zirconium, and zinc. Furthermore, in some embodiments, the matrix material 52 may include at least 90% by weight aluminum, and at least 3% by weight of at least one of copper, magnesium, manganese, scandium, silicon, zirconium, and zinc. Furthermore, trace amounts of at least one of silver, gold, and indium optionally may be included in the matrix material 52 to enhance the wettability of the matrix material relative to the boron carbide particles 50. Table 1 below sets forth various examples of compositions of matrix material 52 that may be used as the particle-matrix composite material 15 of the crown region 14 of the bit body shown in FIG. 1.

TABLE 1

| | Approximate Elemental Weight Percent | | | | | | |
|---|---|---|---|---|---|---|---|
| Example No. | Al | Cu | Mg | Mn | Si | Zr | Zn |
| 1 | 95.0 | 5.0 | — | — | — | — | — |
| 2 | 96.5 | 3.5 | — | — | — | — | — |
| 3 | 94.5 | 4.0 | 1.5 | — | — | — | — |
| 4 | 93.5 | 4.4 | 0.5 | 0.8 | 0.8 | — | — |
| 5 | 93.4 | 4.5 | 1.5 | 0.6 | — | — | — |
| 6 | 93.5 | 4.4 | 1.5 | 0.6 | — | — | — |
| 7 | 89.1 | 2.3 | 2.3 | — | — | 0.1 | 6.2 |

Figure 3:
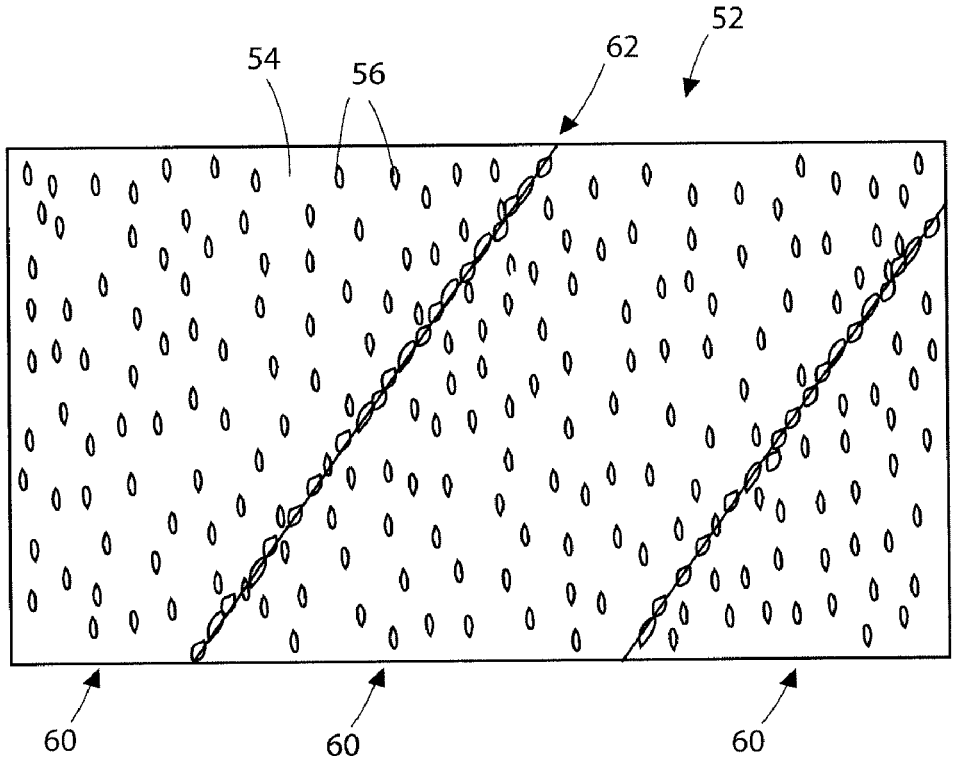
FIG. 3 is an illustration representing one example of how the microstructure of the matrix material of the particle-matrix composite material shown in the micrograph of FIG. 2 may appear at a higher level of magnification.

FIG. 3 is an enlarged view of a region of the matrix material 52 shown in FIG. 2. FIG. 3 illustrates one example of how the microstructure of the matrix material 52 of the particle-matrix composite material 15 may appear in a micrograph at an even greater magnification level than that represented in FIG. 2. Such a micrograph may be acquired using, for example, a scanning electron microscope (SEM) or a transmission electron microscope (TEM).

By way of example and not limitation, the matrix material 52 may include a continuous phase 54 comprising a solid solution. The matrix material 52 may further include a discontinuous phase 56 comprising a plurality of discrete regions, each of which includes precipitates (i.e., a precipitate phase). For example, the matrix material 52 may include a precipitation hardened aluminum-based alloy comprising between about 95% and about 96.5% by weight aluminum and between about 3.5% and about 5% by weight copper. In such a matrix material 52, the solid solution of the continuous phase 54 may include aluminum solvent and copper solute. In other words, the crystal structure of the solid solution may comprise mostly aluminum atoms with a relatively small number of copper atoms substituted for aluminum atoms at random locations throughout the crystal structure. Furthermore, in such a matrix material 52, the discontinuous phase 56 of the matrix material 52 may include one or more intermetallic compound precipitates (e.g., $CuAl_2$). In additional embodiments, the discontinuous phase 56 of the matrix material 52 may include additional discontinuous phases (not shown) present in the matrix material 52 that include metastable transition phases (i.e., non-equilibrium phases that are temporarily formed during formation of an equilibrium precipitate phase (e.g., $CuAl_2$)). Furthermore, in yet additional embodiments, substantially all of the discontinuous phase 56 regions may be substantially comprised of such metastable transition phases. The presence of the discontinuous phase 56 regions within the continuous phase 54 may impart one or more desirable properties to the matrix material 52, such as, for example, increased hardness. Furthermore, in some embodiments, metastable transition phases may impart one or more physical properties to the matrix material 52 that are more desirable than those imparted to the matrix material 52 by equilibrium precipitate phases (e.g., $CuAl_2$).

With continued reference to FIG. 3, the matrix material 52 may include a plurality of grains 60 that abut one another along grain boundaries 62. As shown in FIG. 3, a relatively high concentration of a discontinuous precipitate phase 56 may be present along the grain boundaries 62. In some embodiments of the present invention, the grains 60 of matrix material 52 may have at least one of a size and shape that is tailored to enhance one or more mechanical properties of the matrix material 52. The size and shape of the grains 60 may be selectively tailored using heat treatments such as, for example, quenching and annealing, as known in the art. Furthermore, at least trace amounts of at least one of titanium and boron optionally may be included in the matrix material 52 to facilitate grain size refinement.

Referring again to FIG. 1, the bit body 12 may be secured to the shank 20 by way of, for example, a threaded connection 22 and a weld 24 that extends around the drill bit 10 on an exterior surface thereof along an interface between the bit body 12 and the metal shank 20. The metal shank 20 may be formed from steel, and may include an American Petroleum Institute (API) threaded pin 28 for attaching the drill bit 10 to a drill string (not shown).

As shown in FIG. 1, the bit body 12 may include wings or blades 30 that are separated from one another by junk slots 32. Internal fluid passageways 42 may extend between the face 18 of the bit body 12 and a longitudinal bore 40, which extends through the steel shank 20 and at least partially through the bit body 12. In some embodiments, nozzle inserts (not shown) may be provided at the face 18 of the bit body 12 within the internal fluid passageways 42.

The drill bit 10 may include a plurality of cutting structures on the face 18 thereof. By way of example and not limitation, a plurality of polycrystalline diamond compact (PDC) cutters 34 may provided on each of the blades 30, as shown in FIG. 1. The PDC cutters 34 may be provided along the blades 30 within pockets 36 formed in the face 18 of the bit body 12, and may be supported from behind by buttresses 38, which may be integrally formed with the crown region 14 of the bit body 12.

The steel blank 16 shown in FIG. 1 may be generally cylindrically tubular. In additional embodiments, the steel blank 16 may have a fairly complex configuration and may include external protrusions corresponding to blades 30 or other features extending on the face 18 of the bit body 12.

The rotary drill bit 10 shown in FIG. 1 may be fabricated by separately forming the bit body 12 and the shank 20, and then attaching the shank 20 and the bit body 12 together. The bit body 12 may be formed by, for example, providing a mold (not shown) having a mold cavity having a size and shape corresponding to the size and shape of the bit body 12. The mold may be formed from, for example, graphite or any other high-temperature refractory material, such as a ceramic. The mold cavity of the mold may be machined using a five-axis machine tool. Fine features may be added to the cavity of the mold using hand-held tools. Additional clay work also may be required to obtain the desired configuration of some features of the bit body 12. Where necessary, preform elements or displacements (which may comprise ceramic components, graphite components, or resin-coated sand compact components) may be positioned within the mold cavity and used to define the internal passageways 42, cutting element pockets 36, junk slots 32, and other external topographic features of the bit body 12.

A plurality of boron carbide particles 50 (FIG. 2) may be provided within the mold cavity to form a body comprising having a shape that corresponds to at least the crown region 14 of the bit body 12. The metal blank 16 may be at least partially embedded within the boron carbide particles such that at least one surface of the blank 16 is exposed to allow subsequent machining of the surface of the metal blank 16 (if necessary) and subsequent attachment to the shank 20.

Molten matrix material 52 having a composition as previously described herein then may be prepared by mixing stock material, particulate material, and/or powder material of each of the various elemental constituents in their respective weight percentages in a container and heating the mixture to a temperature sufficient to cause the mixture to melt, forming a molten matrix material 52 of desired composition. The molten matrix material 52 may be poured into the mold cavity of the mold and allowed to infiltrate the spaces between the boron carbide particles 50 previously provided within the mold cavity. Optionally, pressure may be applied to the molten matrix material 52 to facilitate the infiltration process as necessary or desired. As the molten materials (e.g., molten aluminum or aluminum-based alloy materials) may be susceptible to oxidation, the infiltration process may be carried out under vacuum. In additional embodiments, the molten materials may be substantially flooded with an inert gas or a reluctant gas to prevent oxidation of the molten materials. In some embodiments, pressure may be applied to the molten matrix material 52 and boron carbide particles 50 to facilitate the infiltration process and to substantially prevent the formation of voids within the bit body 12 being formed.

After the boron carbide particles 50 have been infiltrated with the molten matrix material 52, the molten matrix material 52 may be allowed to cool and solidify, forming the solid matrix material 52 of the particle-matrix composite material 15.

The matrix material 52 optionally may be subjected to a thermal treatment (after the cooling process or in conjunction with the cooling process) to selectively tailor one or more physical properties thereof, as necessary or desired. For example, the matrix material 52 may be subjected to a precipitation hardening process to form a discontinuous phase 56 comprising precipitates, as previously described in relation to FIG. 3.

In one embodiment, set forth merely as a nonlimiting example, the molten matrix material 52 may comprise between about 95% and about 96.5% by weight aluminum and between about 3.5% and about 5% by weight copper, as previously described. Such molten matrix material 52 may be heated to a temperature of greater than about 548° C. (a eutectic temperature for the particular alloy) for a sufficient time to allow the composition of the molten matrix material 52 to become substantially homogenous. The substantially homogenous molten matrix material 52 may be poured into the mold cavity of the mold and allowed to infiltrate the spaces between the boron carbide particles 50 within the mold cavity. After substantially complete infiltration of the boron carbide particles 50, the temperature of the molten matrix material 52 may be cooled relatively rapidly (i.e., quenched) to a temperature of less than about 100° C. to cause the matrix material 52 to solidify without formation of a significant amount of discontinuous precipitate phases. The temperature of the matrix material 52 then may be heated to a temperature of between about 100° C. and about 548° C. for a sufficient amount of time to allow the formation of a selected amount of discontinuous precipitate phase (e.g., metastable transition precipitation phases, and/or equilibrium precipitation phases). In additional embodiments, the composition of the matrix material 52 may be selected to allow a pre-selected amount of precipitation hardening within the matrix material 52 over time and under ambient temperatures and/or temperatures attained while drilling with the drill bit 10, thereby eliminating the need for a heat treatment at elevated temperatures.

As the particle-matrix composite material 15 used to form the crown region 14 may be relatively hard and not easily machined, the metal blank 16 may be used to secure the bit body 12 to the shank 20. Threads may be machined on an exposed surface of the metal blank 16 to provide the threaded connection 22 between the bit body 12 and the metal shank 20. Such threads may be machined prior or subsequent to forming the crown region 14 of the bit body 12 around the metal blank 16. The metal shank 20 may be screwed onto the bit body 12, and a weld 24 optionally may be provided at least partially along the interface between the bit body 12 and the metal shank 20.

The PDC cutters 34 may be bonded to the face 18 of the bit body 12 after the bit body 12 has been cast by, for example, brazing, mechanical affixation, or adhesive affixation. In other methods, the PDC cutters 34 may be provided within the mold and bonded to the face 18 of the bit body 12 during infiltration or furnacing of the bit body 12 if thermally stable synthetic diamonds, or natural diamonds, are employed.

During drilling operations, the drill bit 10 may be positioned at the bottom of a well bore and rotated while drilling fluid is pumped to the face 18 of the bit body 12 through the longitudinal bore 40 and the internal fluid passageways 42. As the PDC cutters 34 shear or scrape away the underlying earth formation, the formation cuttings and detritus are mixed with and suspended within the drilling fluid, which passes through the junk slots 32 and the annular space between the well bore hole and the drill string to the surface of the earth formation.

In some embodiments, earth-boring rotary drill bits that embody teachings of the present invention may not include a metal blank, such as the metal blank 16 previously described in relation to the drill bit 10 shown in FIG. 1. Furthermore, bit bodies of earth-boring rotary drill bits that embody teachings of the present invention may be formed by methods other than infiltration methods, such as, for example, powder compaction and consolidation methods, as discussed in further detail below.

Figure 4:
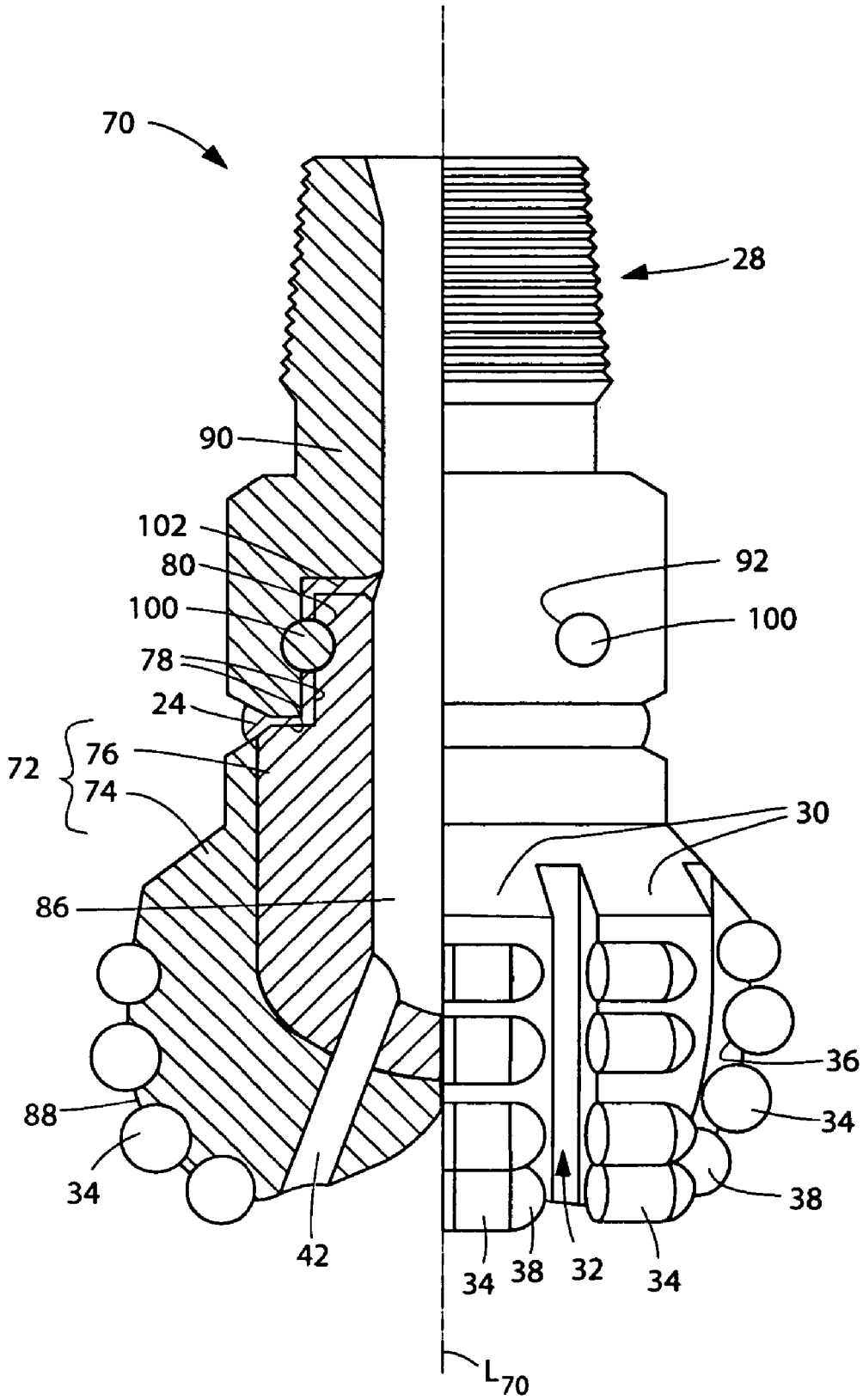
FIG. 4 is a partial cross-sectional side view of another earth-boring rotary drill bit that embodies teachings of the present invention and includes a bit body comprising a particle-matrix composite material.

Another earth-boring rotary drill bit 70 that embodies teachings of the present invention, but does not include a metal blank (such as the metal blank 16 shown in FIG. 1) is shown in FIG. 4. The rotary drill bit 70 has a bit body 72 that includes a particle-matrix composite material comprising a plurality of boron carbide particles dispersed throughout an aluminum or an aluminum-based alloy matrix material, as previously described herein in relation to FIGS. 1-3. The drill bit 70 may also include a shank 90 attached directly to the bit body 72.

The shank 90 includes a generally cylindrical outer wall having an outer surface and an inner surface. The outer wall of the shank 90 encloses at least a portion of a longitudinal bore 86 that extends through the drill bit 70. At least one surface of the outer wall of the shank 90 may be configured for attachment of the shank 90 to the bit body 72. The shank 90 also may include a male or female API threaded connection portion 28 for attaching the drill bit 70 to a drill string (not shown). One or more apertures 92 may extend through the outer wall of the shank 90. These apertures are described in greater detail below.

In some embodiments, the bit body 72 of the rotary drill bit 70 may be substantially comprised of a particle-matrix composite material. Furthermore, the composition of the particle-matrix composite material may be selectively varied within the bit body 72 to provide various regions within the bit body 72 that have different, custom tailored physical properties or characteristics.

By way of example and not limitation, the bit body 72 may include a first region 74 having a first material composition and a second region 76 having a second, different material composition. The first region 74 may include the longitudinally lower and laterally outward regions of the bit body 72 (e.g., the crown region of the bit body 72). The first region 74 may include the face 88 of the bit body 72, which may be configured to carry a plurality of cutting elements, such as PDC cutters 34. For example, a plurality of pockets 36 and buttresses 38 may be provided in or on the face 88 of the bit body 72 for carrying and supporting the PDC cutters 34. Furthermore, a plurality of blades 30 and junk slots 32 may be provided in the first region 74 of the bit body 72. The second region 76 may include the longitudinally upper and laterally inward regions of the bit body 72. The longitudinal bore 86 may extend at least partially through the second region 76 of the bit body 72.

The second region 76 may include at least one surface 78 that is configured for attachment of the bit body 72 to the shank 90. By way of example and not limitation, at least one groove 80 may be formed in at least one surface 78 of the second region 76 that is configured for attachment of the bit body 72 to the shank 90. Each groove 80 may correspond to and be aligned with an aperture 92 extending through the outer wall of the shank 90. A retaining member 100 may be provided within each aperture 92 in the shank 90 and each groove 80. Mechanical interference between the shank 90, the retaining member 100, and the bit body 72 may prevent longitudinal separation of the bit body 72 from the shank 90, and may prevent rotation of the bit body 72 about a longitudinal axis $L_{70}$ of the rotary drill bit 70 relative to the shank 90.

In the embodiment shown in FIG. 4, the rotary drill bit 70 includes two retaining members 100. By way of example and not limitation, each retaining member 100 may include an elongated, cylindrical rod that extends through an aperture 92 in the shank 90 and a groove 80 formed in a surface 78 of the bit body 72.

The mechanical interference between the shank 90, the retaining member 100, and the bit body 72 may also provide a substantially uniform clearance or gap between a surface of the shank 90 and the surfaces 78 in the second region 76 of the bit body 72. By way of example and not limitation, a substantially uniform gap of between about 50 microns (0.002 inch) and about 150 microns (0.006 inch) may be provided between the shank 90 and the bit body 72 when the retaining members 100 are disposed within the apertures 92 in the shank 90 and the grooves 80 in the bit body 72.

A brazing material 102 such as, for example, a silver-based or a nickel-based metal alloy may be provided in the substantially uniform gap between the shank 90 and the surfaces 78 in the second region 76 of the bit body 72. As an alternative to brazing, or in addition to brazing, a weld 24 may be provided around the rotary drill bit 70 on an exterior surface thereof along an interface between the bit body 72 and the steel shank 90. The weld 24 and the brazing material 102 may be used to further secure the shank 90 to the bit body 72. In this configuration, if the brazing material 102 in the substantially uniform gap between the shank 90 and the surfaces 78 in the second region 76 of the bit body 72 and the weld 24 should fail while the drill bit 70 is located at the bottom of a well bore-hole during a drilling operation, the retaining members 100 may prevent longitudinal separation of the bit body 72 from the shank 90, thereby preventing loss of the bit body 72 in the well bore-hole.

As previously stated, the first region 74 of the bit body 72 may have a first material composition and the second region 76 of the bit body 72 may have a second, different material composition. The first region 74 may include a particle-matrix composite material comprising a plurality of boron carbide particles dispersed throughout an aluminum or aluminum-based alloy matrix material. The second region 76 of the bit body 72 may include a metal, a metal alloy, or a particle-matrix composite material. For example, the second region 76 of the bit body 72 may be substantially comprised by an aluminum or an aluminum-based alloy material substantially identical to the matrix material of the first region 74. In additional embodiments of the present invention, both the first region 74 and the second region 76 of the bit body 72 may be substantially formed from and composed of a particle-matrix composite material.

By way of example and not limitation, the material composition of the first region 74 may be selected to exhibit higher erosion and wear-resistance than the material composition of the second region 76. The material composition of the second region 76 may be selected to facilitate machining of the second region 76.

The manner in which the physical properties may be tailored to facilitate machining of the second region 76 may be at least partially dependent of the method of machining that is to be used. For example, if it is desired to machine the second region 76 using conventional turning, milling, and drilling techniques, the material composition of the second region 76 may be selected to exhibit lower hardness and higher ductility. If it is desired to machine the second region 76 using ultrasonic machining techniques, which may include the use of ultrasonically induced vibrations delivered to a tool, the composition of the second region 76 may be selected to exhibit a higher hardness and a lower ductility.

In some embodiments, the material composition of the second region 76 may be selected to exhibit higher fracture toughness than the material composition of the first region 74. In yet other embodiments, the material composition of the second region 76 may be selected to exhibit physical properties that are tailored to facilitate welding of the second region 76. By way of example and not limitation, the material composition of the second region 76 may be selected to facilitate welding of the second region 76 to the shank 90. It is understood that the various regions of the bit body 72 may have material compositions that are selected or tailored to exhibit any desired particular physical property or characteristic, and the present invention is not limited to selecting or tailoring the material compositions of the regions to exhibit the particular physical properties or characteristics described herein.

Certain physical properties and characteristics of a composite material (such as hardness) may be defined using an appropriate rule of mixtures, as is known in the art. Other physical properties and characteristics of a composite material may be determined without resort to the rule of mixtures. Such physical properties may include, for example, erosion and wear resistance.

FIGS. 5A-5J illustrate on example of a method that may be used to form the bit body 72 shown in FIG. 4. Generally, the bit body 72 of the rotary drill bit 70 may be formed by separately forming the first region 74 and the second region 76 as brown structures, assembling the brown structures together to provide a unitary brown bit body, and sintering the unitary brown bit body to a desired final density.

Figure 5A:
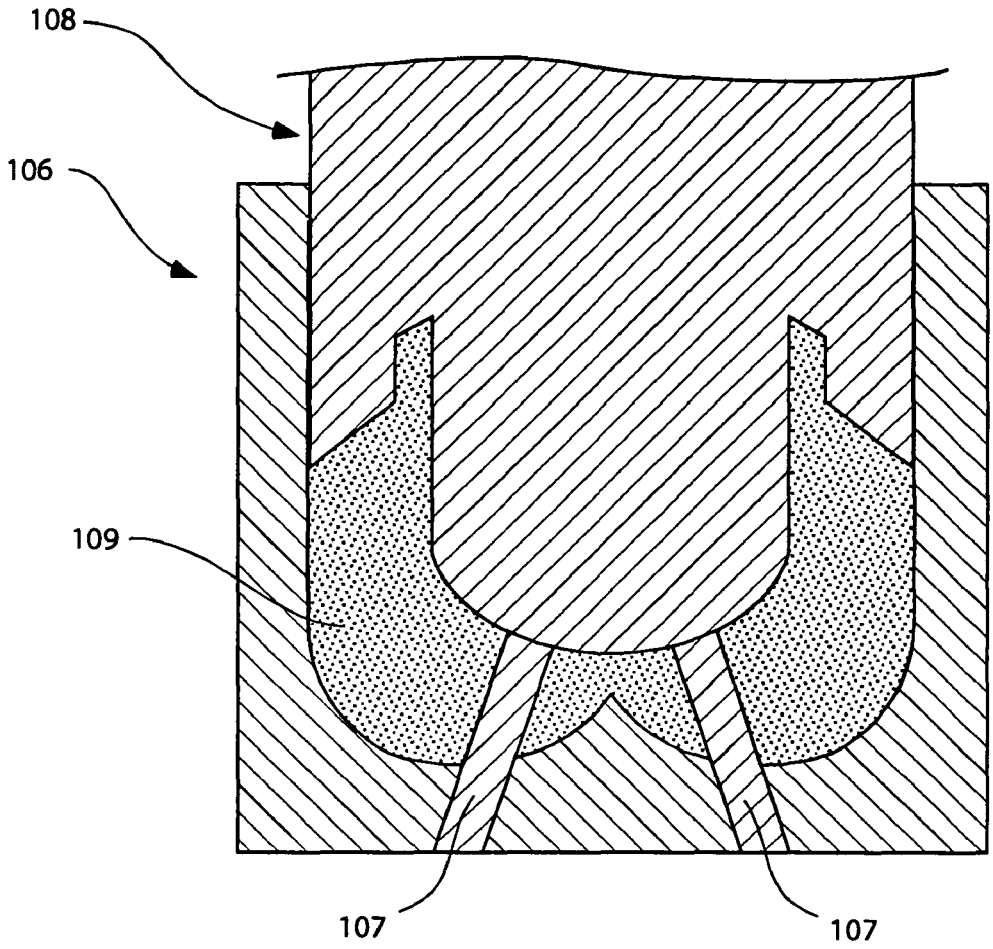
FIGS. 5A-5J illustrate one example of a method that may be used to form the bit body of the earth-boring rotary drill bit shown in FIG. 4.

Referring to FIG. 5A, a first powder mixture 109 may be pressed in a mold or die 106 using a movable piston or plunger 108. The first powder mixture 109 may include a plurality of boron carbide particles and a plurality of particles comprising an aluminum or an aluminum-based alloy matrix material. Optionally, the powder mixture 109 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The die 106 may include an inner cavity having surfaces shaped and configured to form at least some surfaces of the first region 74 of the bit body 72. The plunger 108 may also have surfaces configured to form or shape at least some of the surfaces of the first region 74 of the bit body 72. Inserts or displacements 107 may be positioned within the die 106 and used to define the internal fluid passageways 42. Additional displacements 107 (not shown) may be used to define cutting element pockets 36, junk slots 32, and other topographic features of the first region 74 of the bit body 72.

Figure 5B:
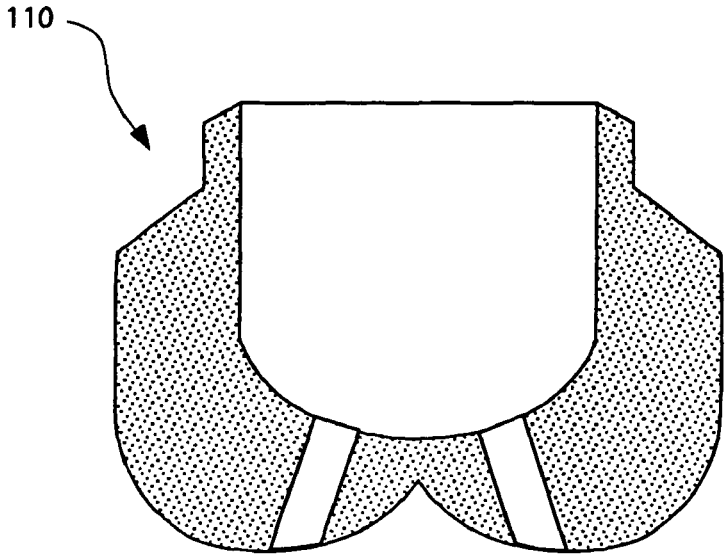
Figure 5C:
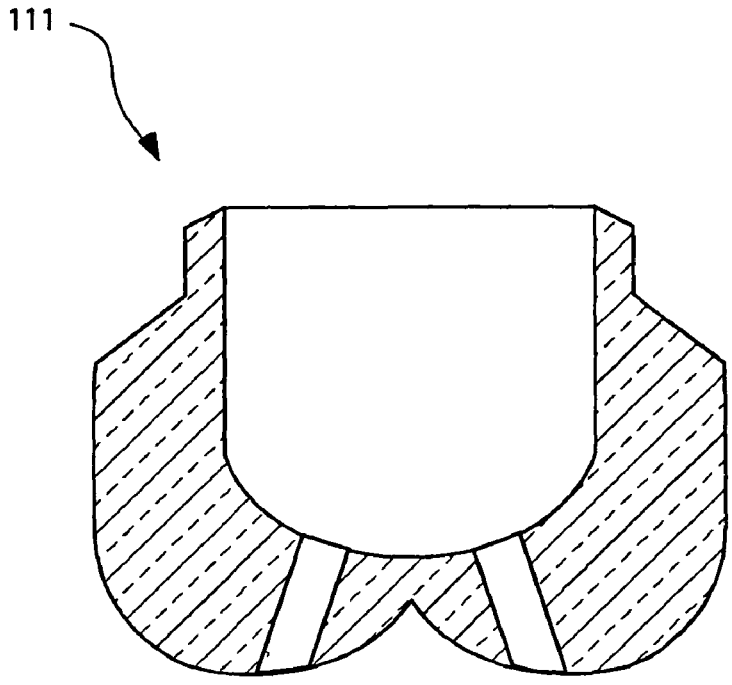

The plunger 108 may be advanced into the die 106 at high force using mechanical or hydraulic equipment or machines to compact the first powder mixture 109 within the die 106 to form a first green powder component 110, shown in FIG. 5B. The die 106, plunger 108, and the first powder mixture 109 optionally may be heated during the compaction process.

In additional methods of pressing the powder mixture 109, the powder mixture 109 may be pressed with substantially isostatic pressures inside a pliable, hermetically sealed container that is provided within a pressure chamber.

The first green powder component 110 shown in FIG. 5B may include a plurality of particles (hard particles and particles of matrix material) held together by a binder material provided in the powder mixture 109 (FIG. 5A), as previously described. Certain structural features may be machined in the green powder component 110 using conventional machining techniques including, for example, turning techniques, milling techniques, and drilling techniques. Hand held tools also may be used to manually form or shape features in or on the green powder component 110. By way of example and not limitation, junk slots 32 (FIG. 4) may be machined or otherwise formed in the green powder component 110.

The first green powder component 110 shown in FIG. 5B may be at least partially sintered. For example, the green powder component 110 may be partially sintered to provide a first brown structure 111 shown in FIG. 5C, which has less than a desired final density. Prior to sintering, the green powder component 110 may be subjected to moderately elevated temperatures to aid in the removal of any fugitive additives that were included in the powder mixture 109 (FIG. 5A), as previously described. Furthermore, the green powder component 110 may be subjected to a suitable atmosphere tailored to aid in the removal of such additives. Such atmospheres may include, for example, hydrogen gas at a temperature of about 500° C.

Certain structural features may be machined in the first brown structure 111 using conventional machining techniques including, for example, turning techniques, milling techniques, and drilling techniques. Hand held tools may also be used to manually form or shape features in or on the brown structure 111. By way of example and not limitation, cutter pockets 36 may be machined or otherwise formed in the brown structure 111 to form a shaped brown structure 112 shown in FIG. 5D.

Figure 5D:
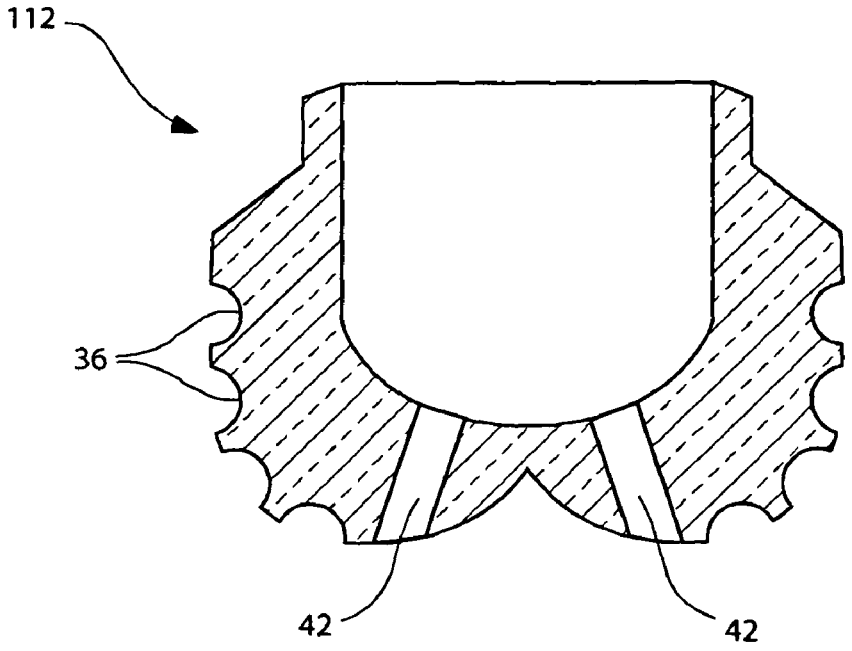
Figure 5E:
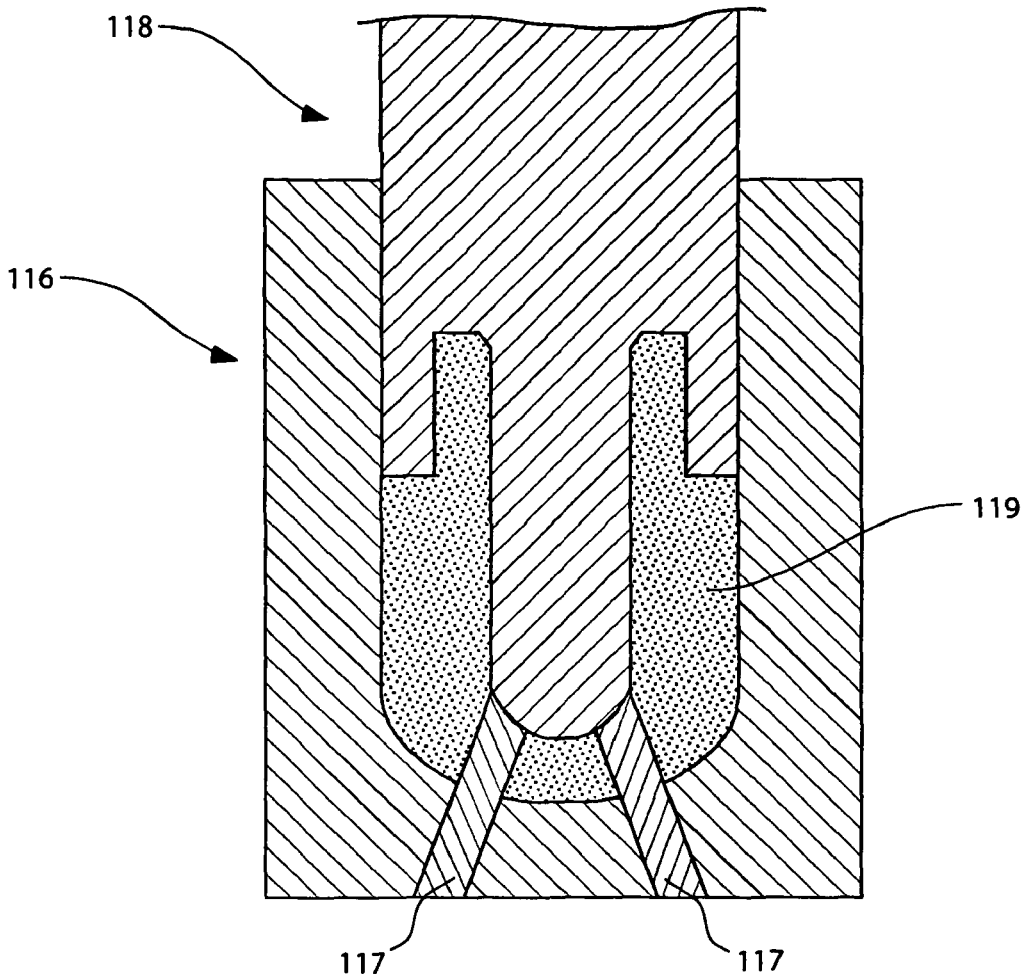

Referring to FIG. 5E, a second powder mixture 119 may be pressed in a mold or die 116 using a movable piston or plunger 118. The second powder mixture 119 may include a plurality of particles comprising an aluminum or aluminum-based alloy matrix material, and optionally may include a plurality of boron carbide particles. Optionally, the powder mixture 119 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The die 116 may include an inner cavity having surfaces shaped and configured to form at least some surfaces of the second region 76 of the bit body 72. The plunger 118 may also have surfaces configured to form or shape at least some of the surfaces of the second region 76 of the bit body 72. One or more inserts or displacements 117 may be positioned within the die 116 and used to define the internal fluid passageways 42. Additional displacements 117 (not shown) may be used to define other topographic features of the second region 76 of the bit body 72 as necessary.

Figure 5F:
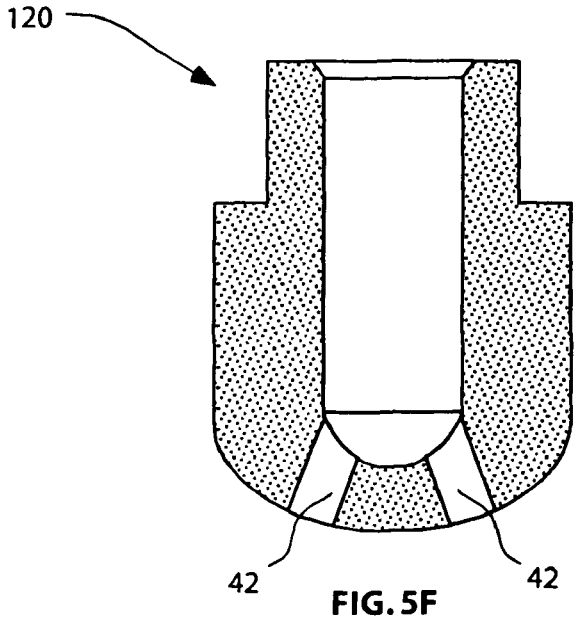

The plunger 118 may be advanced into the die 116 at high force using mechanical or hydraulic equipment or machines to compact the second powder mixture 119 within the die 116 to form a second green powder component 120, shown in FIG. 5F. The die 116, plunger 118, and the second powder mixture 119 optionally may be heated during the compaction process.

In additional methods of pressing the powder mixture 119, the powder mixture 119 may be pressed with substantially isostatic pressures inside a pliable, hermetically sealed container that is provided within a pressure chamber.

The second green powder component 120 shown in FIG. 5F may include a plurality of particles (particles of aluminum or aluminum-based alloy matrix material, and optionally, boron carbide particles) held together by a binder material provided in the powder mixture 119 (FIG. 5E), as previously described. Certain structural features may be machined in the green powder component 120 as necessary using conventional machining techniques including, for example, turning techniques, milling techniques, and drilling techniques. Hand held tools also may be used to manually form or shape features in or on the green powder component 120.

The second green powder component 120 shown in FIG. 5F may be at least partially sintered. For example, the green powder component 120 may be partially sintered to provide a second brown structure 121 shown in FIG. 5G, which has less than a desired final density. Prior to sintering, the green powder component 120 may be subjected to moderately elevated temperatures to burn off or remove any fugitive additives that were included in the powder mixture 119 (FIG. 5E), as previously described.

Certain structural features may be machined in the second brown structure 121 as necessary using conventional machining techniques including, for example, turning techniques, milling techniques, and drilling techniques. Hand held tools may also be used to manually form or shape features in or on the brown structure 121.

Figure 5G:
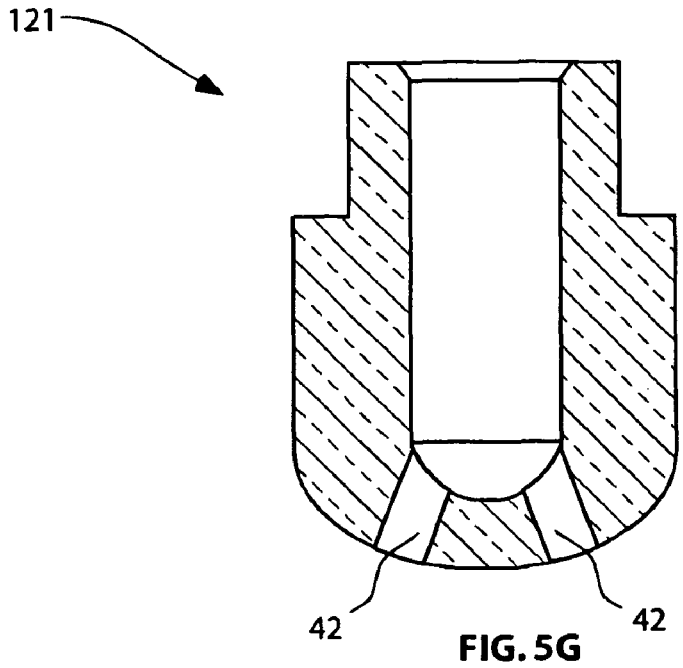
Figure 5H:
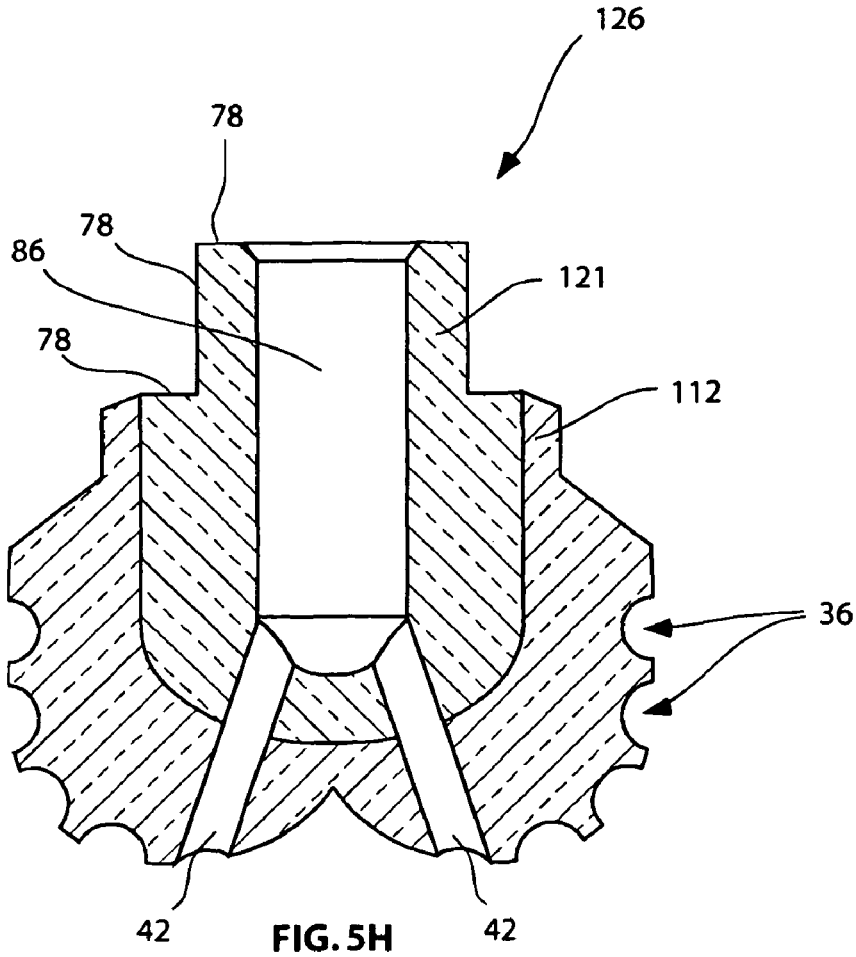

The brown structure 121 shown in FIG. 5G then may be inserted into the previously formed shaped brown structure 112 shown in FIG. 5D to provide a unitary brown bit body 126 shown in FIG. 5H. The unitary brown bit body 126 then may be fully sintered to a desired final density to provide the previously described bit body 72 shown in FIG. 4. As sintering involves densification and removal of porosity within a structure, the structure being sintered will shrink during the sintering process. A structure may experience linear shrinkage of between 10% and 20% during sintering. As a result, dimensional shrinkage must be considered and accounted for when designing tooling (molds, dies, etc.) or machining features in structures that are less than fully sintered.

In another method, the green powder component 120 shown in FIG. 5F may be inserted into or assembled with the green powder component 110 shown in FIG. 5B to form a green bit body. The green bit body then may be machined as necessary and sintered to a desired final density. The interfacial surfaces of the green powder component 110 and the green powder component 120 may be fused or bonded together during sintering processes. In other methods, the green bit body may be partially sintered to a brown bit body. Shaping and machining processes may be performed on the brown bit body as necessary, and the resulting brown bit body then may be sintered to a desired final density.

The material composition of the first region 74 (and therefore, the composition of the first powder mixture 109 shown in FIG. 5A) and the material composition of the second region 76 (and therefore, the composition of the second powder mixture 119 shown in FIG. 5E) may be selected to exhibit substantially similar shrinkage during the sintering processes.

The sintering processes described herein may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering processes described herein may include subliquidus phase sintering. In other words, the sintering processes may be conducted at temperatures proximate to but below the liquidus line of the phase diagram for the matrix material. For example, the sintering processes described herein may be conducted using a number of different methods known to one of ordinary skill in the art such as the Rapid Omnidirectional Compaction (ROC) process, the CERACON™ process, hot isostatic pressing (HIP), or adaptations of such processes.

Broadly, and by way of example only, sintering a green powder compact using the ROC process involves presintering the green powder compact at a relatively low temperature to only a sufficient degree to develop sufficient strength to permit handling of the powder compact. The resulting brown structure is wrapped in a material such as graphite foil to seal the brown structure. The wrapped brown structure is placed in a container, which is filled with particles of a ceramic, polymer, or glass material having a substantially lower melting point than that of the matrix material in the brown structure. The container is heated to the desired sintering temperature, which is above the melting temperature of the particles of a ceramic, polymer, or glass material, but below the liquidus temperature of the matrix material in the brown structure. The heated container with the molten ceramic, polymer, or glass material (and the brown structure immersed therein) is placed in a mechanical or hydraulic press, such as a forging press, that is used to apply pressure to the molten ceramic or polymer material. Isostatic pressures within the molten ceramic, polymer, or glass material facilitate consolidation and sintering of the brown structure at the elevated temperatures within the container. The molten ceramic, polymer, or glass material acts to transmit the pressure and heat to the brown structure. In this manner, the molten ceramic, polymer, or glass acts as a pressure transmission medium through which pressure is applied to the structure during sintering. Subsequent to the release of pressure and cooling, the sintered structure is then removed from the ceramic, polymer, or glass material. A more detailed explanation of the ROC process and suitable equipment for the practice thereof is provided by U.S. Pat. Nos. 4,094,709, 4,233,720, 4,341,557, 4,526,748, 4,547,337, 4,562,990, 4,596,694, 4,597,730, 4,656,002, 4,744,943 and 5,232,522, the disclosure of each of which patents is incorporated herein by reference.

The CERACON™ process, which is similar to the aforementioned ROC process, may also be adapted for use in the present invention to fully sinter brown structures to a final density. In the CERACON™ process, the brown structure is coated with a ceramic coating such as alumina, zirconium oxide, or chrome oxide. Other similar, hard, generally inert, protective, removable coatings may also be used. The coated brown structure is fully consolidated by transmitting at least substantially isostatic pressure to the coated brown structure using ceramic particles instead of a fluid media as in the ROC process. A more detailed explanation of the CERACON™ process is provided by U.S. Pat. No. 4,499,048, the disclosure of which patent is incorporated herein by reference.

Figure 5I:
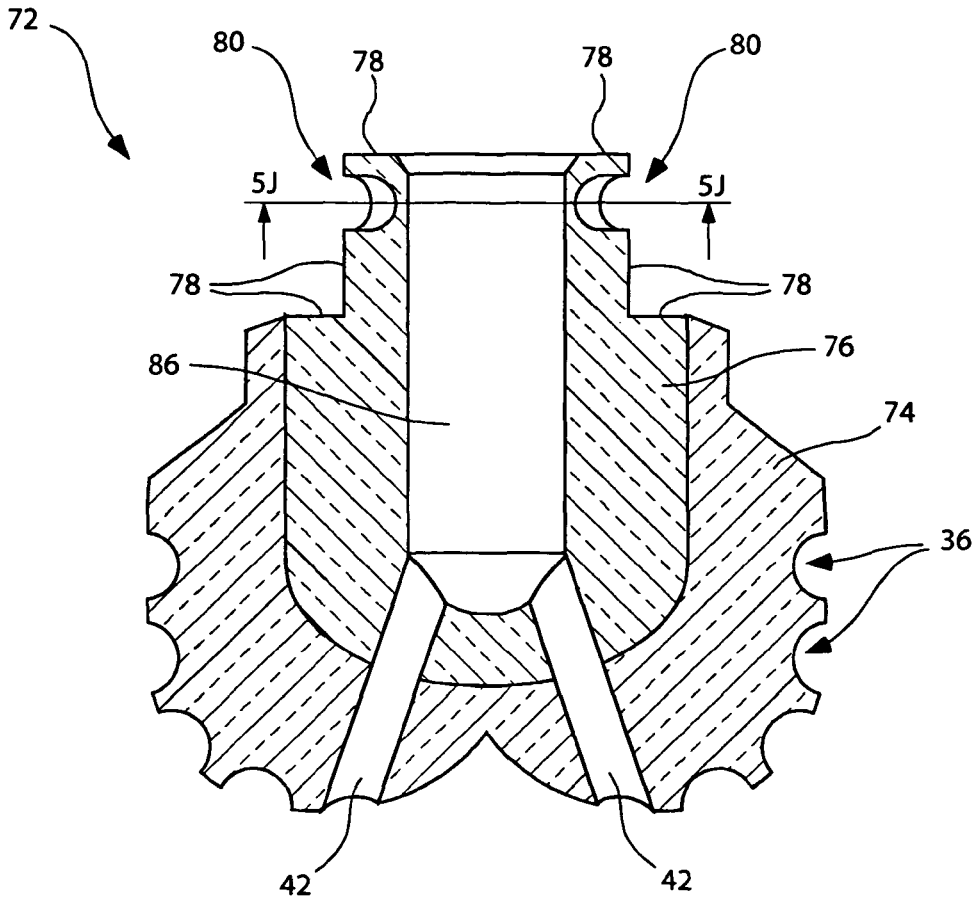
Figure 5J:
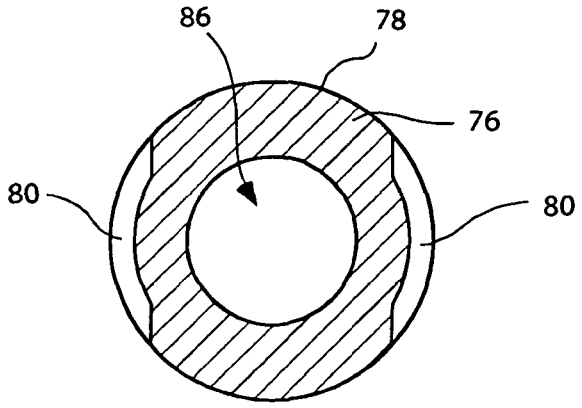

As previously described, the material composition of the second region 76 of the bit body 72 may be selected to facilitate the machining operations performing on the second region 76, even in the fully sintered state. After sintering the unitary brown bit body 126 shown in FIG. 5H to the desired final density, certain features may be machined in the fully sintered structure to provide the bit body 72, which is shown separate from the shank 90 (FIG. 4) in FIG. 5I. For example, the surfaces 78 of the second region 76 of the bit body 72 may be machined to provide elements or features for attaching the shank 90 (FIG. 4) to the bit body 72. By way of example and not limitation, two grooves 80 may be machined in a surface 78 of the second region 76 of the bit body 72, as shown in FIG. 5I. Each groove 80 may have, for example, a semi-circular cross section. Furthermore, each groove 80 may extend radially around a portion of the second region 76 of the bit body 72, as illustrated in FIG. 5J. In this configuration, the surface of the second region 76 of the bit body 72 within each groove 80 may have a shape comprising an angular section of a partial toroid. As used herein, the term "toroid" means a surface generated by a closed curve (such as a circle) rotating about, but not intersecting or containing, an axis disposed in a plane that includes the closed curve. In other embodiments, the surface of the second region 76 of the bit body 72 within each groove 80 may have a shape that substantially forms a partial cylinder. The two grooves 80 may be located on substantially opposite sides of the second region 76 of the bit body 72, as shown in FIG. 5J.

As described herein, the first region 74 and the second region 76 of the bit body 72 may be separately formed in the brown state and assembled together to form a unitary brown structure, which can then be sintered to a desired final density. In additional methods of forming the bit body 72, the first region 74 may be formed by pressing a first powder mixture in a die to form a first green powder component, adding a second powder mixture to the same die and pressing the second powder mixture within the die together with the first powder component of the first region 74 to form a monolithic green bit body. Furthermore, a first powder mixture and a second powder mixture may be provided in a single die and simultaneously pressed to form a monolithic green bit body. The monolithic green bit body then may be machined as necessary and sintered to a desired final density. In yet other methods, the monolithic green bit body may be partially sintered to a brown bit body. Shaping and machining processes may be performed on the brown bit body as necessary, and the resulting brown bit body then may be sintered to a desired final density. The monolithic green bit body may be formed in a single die using two different plungers, such as the plunger 108 shown in FIG. 5A and the plunger 118 shown in FIG. 5E. Furthermore, additional powder mixtures may be provided as necessary to provide any desired number of regions within the bit body 72 having a material composition.

Figure 6A:
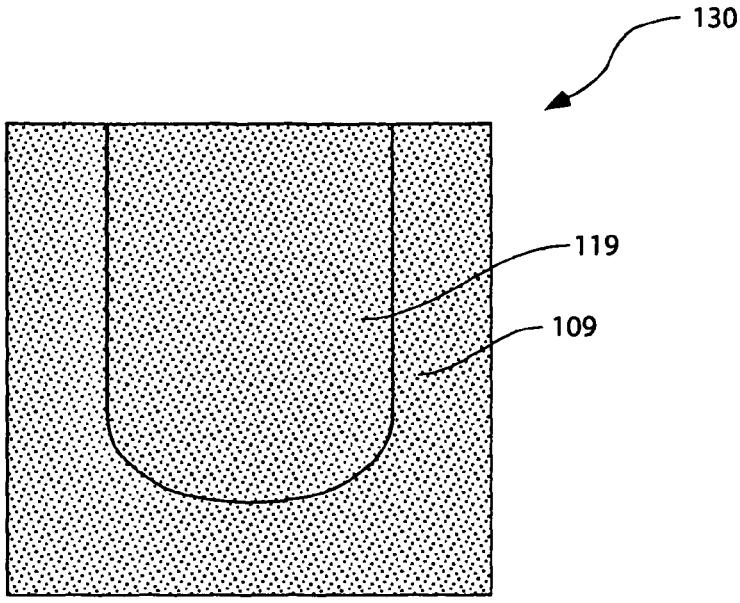
FIGS. 6A-6C illustrate another example of a method that may be used to form the bit body of the earth-boring rotary drill bit shown in FIG. 4.
Figure 6B:
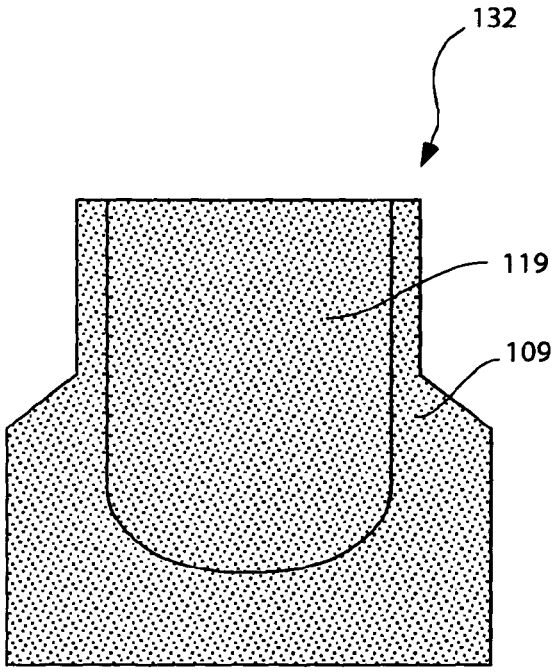
Figure 6C:
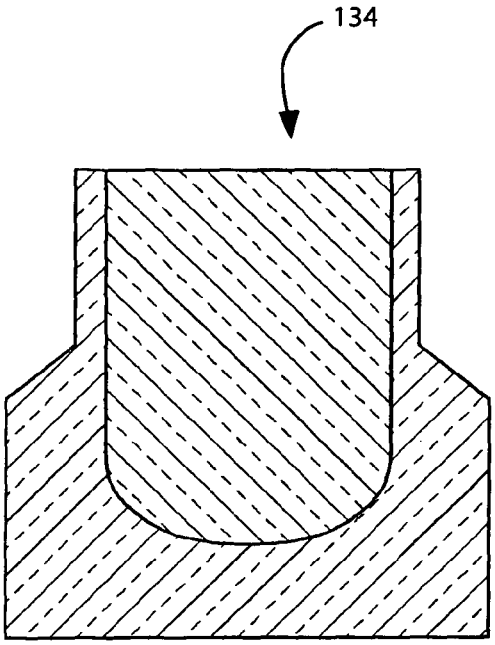

FIGS. 6A-6C illustrate another method of forming the bit body 72. Generally, the bit body 72 of the rotary drill bit 70 may be formed by pressing the previously described first powder mixture 109 (FIG. 5A) and the previously described second powder mixture 119 (FIG. 5E) to form a generally cylindrical monolithic green bit body 130 or billet, as shown in FIG. 6A. By way of example and not limitation, the generally cylindrical monolithic green bit body 130 may be formed by substantially simultaneously isostatically pressing the first powder mixture 109 and the second powder mixture 119 together in a pressure chamber.

By way of example and not limitation, the first powder mixture 109 and the second powder mixture 119 may be provided within a container. The container may include a fluid-tight deformable member, such as, for example, a substantially cylindrical bag comprising a deformable polymer material. The container (with the first powder mixture 109 and the second powder mixture 119 contained therein) may be provided within a pressure chamber. A fluid, such as, for example, water, oil, or gas (such as, for example, air or nitrogen) may be pumped into the pressure chamber using a pump. The high pressure of the fluid causes the walls of the deformable member to deform. The pressure may be transmitted substantially uniformly to the first powder mixture 109 and the second powder mixture 119. The pressure within the pressure chamber during isostatic pressing may be greater than about 35 megapascals (about 5,000 pounds per square inch). More particularly, the pressure within the pressure chamber during isostatic pressing may be greater than about 138 megapascals (20,000 pounds per square inch). In additional methods, a vacuum may be provided within the container and a pressure greater than about 0.1 megapascal (about 15 pounds per square inch), may be applied to the exterior surfaces of the container (by, for example, the atmosphere) to compact the first powder mixture 109 and the second powder mixture 119. Isostatic pressing of the first powder mixture 109 and the second powder mixture 119 may form the generally cylindrical monolithic green bit body 130 shown in FIG. 6A, which can be removed from the pressure chamber after pressing.

The generally cylindrical monolithic green bit body 130 shown in FIG. 6A may be machined or shaped as necessary. By way of example and not limitation, the outer diameter of an end of the generally cylindrical monolithic green bit body 130 may be reduced to form the shaped monolithic green bit body 132 shown in FIG. 6B. For example, the generally cylindrical monolithic green bit body 130 may be turned on a lathe to form the shaped monolithic green bit body 132. Additional machining or shaping of the generally cylindrical monolithic green bit body 130 may be performed as necessary or desired. In other methods, the generally cylindrical monolithic green bit body 130 may be turned on a lathe to ensure that the monolithic green bit body 130 is substantially cylindrical without reducing the outer diameter of an end thereof or otherwise changing the shape of the monolithic green bit body 130.

The shaped monolithic green bit body 132 shown in FIG. 6B then may be partially sintered to provide a brown bit body 134 shown in FIG. 6C. The brown bit body 134 then may be machined as necessary to form a structure substantially identical to the previously described shaped unitary brown bit body 126 shown in FIG. 5H. By way of example and not limitation, the longitudinal bore 86 and internal fluid passageways 42 (FIG. 5H) may be formed in the brown bit body 134 (FIG. 6C) by, for example, using a machining process. A plurality of pockets 36 for PDC cutters 34 also may be machined in the brown bit body 134 (FIG. 6C). Furthermore, at least one surface 78 (FIG. 5H) that is configured for attachment of the bit body 72 to the shank 90 (FIG. 4) may be machined in the brown bit body 134 (FIG. 6C).

After the brown bit body 134 shown in FIG. 6C has been machined to form a structure substantially identical to the shaped unitary brown bit body 126 shown in FIG. 5H, the structure may be further sintered to a desired final density and certain additional features may be machined in the fully sintered structure as necessary to provide the bit body 72, as previously described.

Referring again to FIG. 4, the shank 90 may be attached to the bit body 72 by providing a brazing material 102 such as, for example, a silver-based or nickel-based metal alloy in the gap between the shank 90 and the surfaces 78 in the second region 76 of the bit body 72. As an alternative to brazing, or in addition to brazing, a weld 24 may be provided around the rotary drill bit 70 on an exterior surface thereof along an interface between the bit body 72 and the steel shank 90. The brazing material 102 and the weld 24 may be used to secure the shank 90 to the bit body 72.

Figure 7:
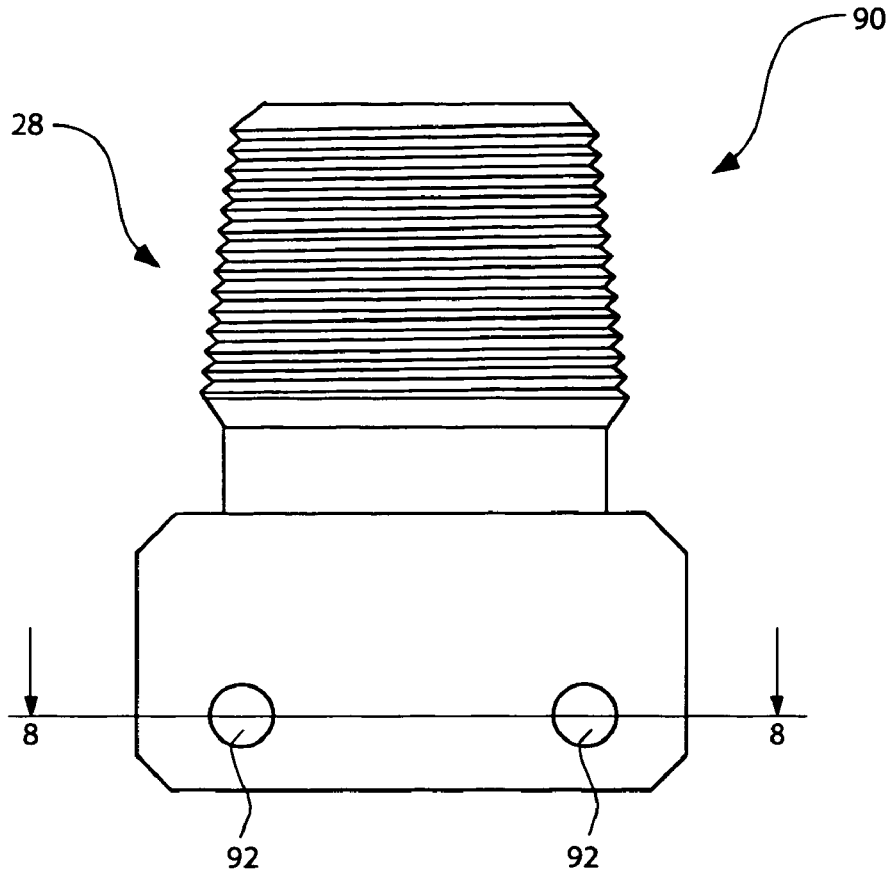
FIG. 7 is a side view of a shank shown in FIG. 4.
Figure 8:
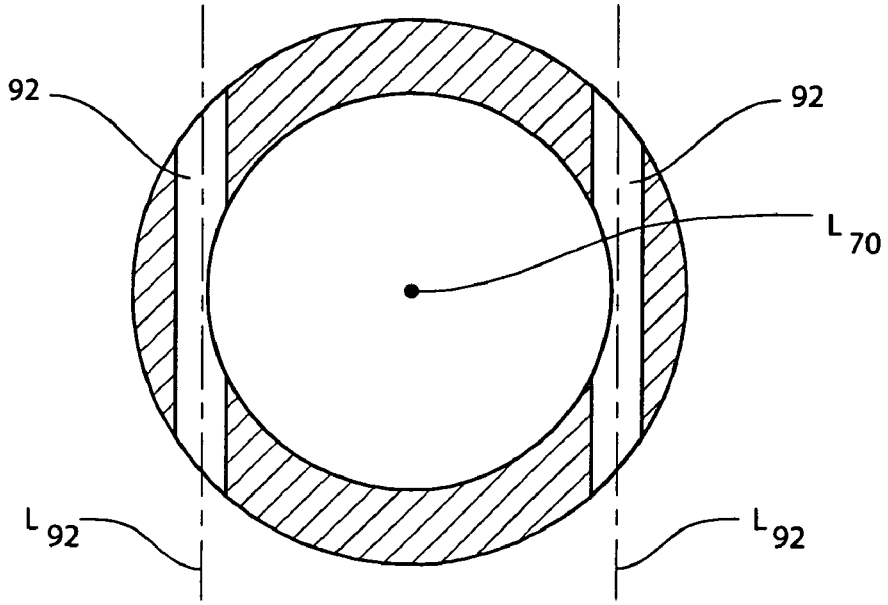
FIG. 8 is a cross-sectional view of the shank shown in FIG. 7 taken along section line 8-8 shown therein.

In additional methods, structures or features that provide mechanical interference may be used in addition to, or instead of, the brazing material 102 and weld 24 to secure the shank 90 to the bit body 72. An example of such a method of attaching a shank 90 to the bit body 72 is described below with reference to FIG. 4 and FIGS. 7 and 8. Referring to FIG. 7, two apertures 92 may be provided through the shank 90, as previously described in relation to FIG. 4. Each aperture 92 may have a size and shape configured to receive a retaining member 100 (FIG. 4) therein. By way of example and not limitation, each aperture 92 may have a substantially cylindrical cross section and may extend through the shank 90 along an axis $L_{92}$, as shown in FIG. 8. The location and orientation of each aperture 92 in the shank 90 may be such that each axis $L_{92}$ lies in a plane that is substantially perpendicular to the longitudinal axis $L_{70}$ of the drill bit 70, but does not intersect the longitudinal axis $L_{70}$ of the drill bit 70.

When a retaining member 100 is inserted through an aperture 92 of the shank 90 and a groove 80, the retaining member 100 may abut against a surface of the second region 76 of the bit body 72 within the groove 80 along a line of contact if the groove 80 has a shape comprising an angular section of a partial toroid, as shown in FIGS. 5I and 5J. If the groove 80 has a shape that substantially forms a partial cylinder, however, the retaining member 100 may abut against an area on the surface of the second region 76 of the bit body 72 within the groove 80.

In some embodiments, each retaining member 100 may be secured to the shank 90. By way of example and not limitation, if each retaining member 100 includes an elongated, cylindrical rod as shown in FIG. 4, the ends of each retaining member 100 may be welded to the shank 90 along the interface between the end of each retaining member 100 and the shank 90. In additional embodiments, a brazing or soldering material (not shown) may be provided between the ends of each retaining member 100 and the shank 90. In still other embodiments, threads may be provided on an exterior surface of each end of each retaining member 100 and cooperating threads may be provided on surfaces of the shank 90 within the apertures 92.

Referring again to FIG. 4, the brazing material 102 such as, for example, a silver-based or nickel-based metal alloy may be provided in the substantially uniform gap between the shank 90 and the surfaces 78 in the second region 76 of the bit body 72. The weld 24 may be provided around the rotary drill bit 70 on an exterior surface thereof along an interface between the bit body 72 and the steel shank 90. The weld 24 and the brazing material 102 may be used to further secure the shank 90 to the bit body 72. In this configuration, if the brazing material 102 in the substantially uniform gap between the shank 90 and the surfaces 78 in the second region 76 of the bit body 72 and the weld 24 should fail while the drill bit 70 is located at the bottom of a well bore-hole during a drilling operation, the retaining members 100 may prevent longitudinal separation of the bit body 72 from the shank 90, thereby preventing loss of the bit body 72 in the well bore-hole.

In additional methods of attaching the shank 90 to the bit body 72, only one retaining member 100 or more than two retaining members 100 may be used to attach the shank 90 to the bit body 72. In yet other embodiments, a threaded connection may be provided between the second region 76 of the bit body 72 and the shank 90. As the material composition of the second region 76 of the bit body 72 may be selected to facilitate machining thereof even in the fully sintered state, threads having precise dimensions may be machined on the second region 76 of the bit body 72. In additional embodiments, the interface between the shank 90 and the bit body 72 may be substantially tapered. Furthermore, a shrink fit or a press fit may be provided between the shank 90 and the bit body 72.

In the embodiment shown in FIG. 4, the bit body 72 includes two distinct regions having material compositions with an identifiable boundary or interface therebetween. In additional embodiments, the material composition of the bit body 72 may be continuously varied between regions within the bit body 72 such that no boundaries or interfaces between regions are readily identifiable. In additional embodiments, the bit body 72 may include more than two regions having material compositions, and the spatial location of the various regions having material compositions within the bit body 72 may be varied.

Figure 9:
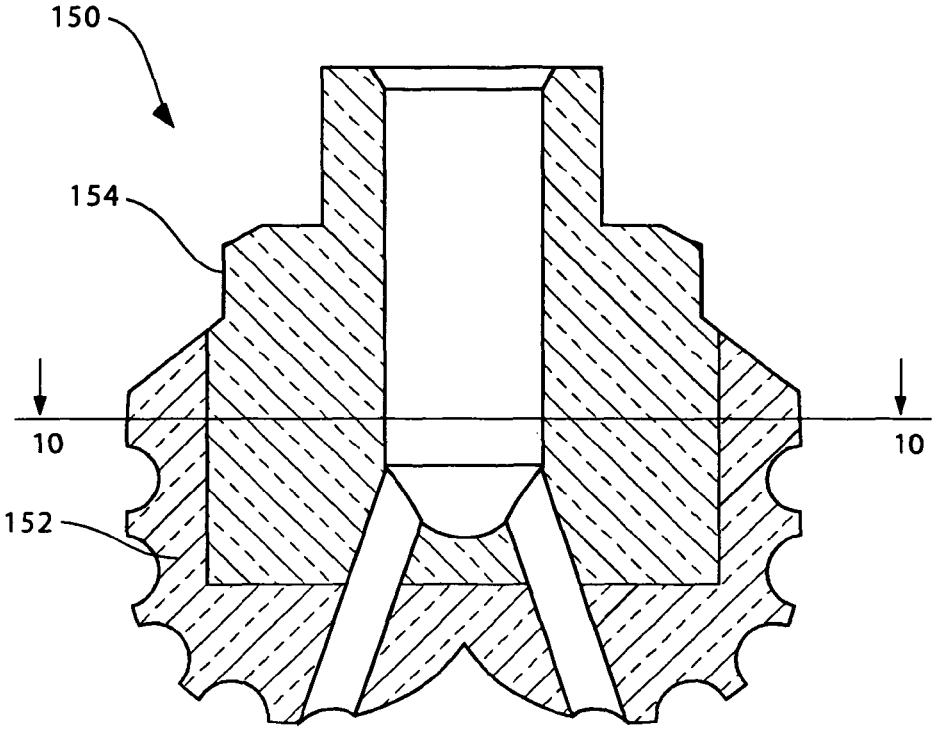
FIG. 9 is a cross-sectional side view of yet another bit body that includes a particle-matrix composite material and that embodies teachings of the present invention.
Figure 10:
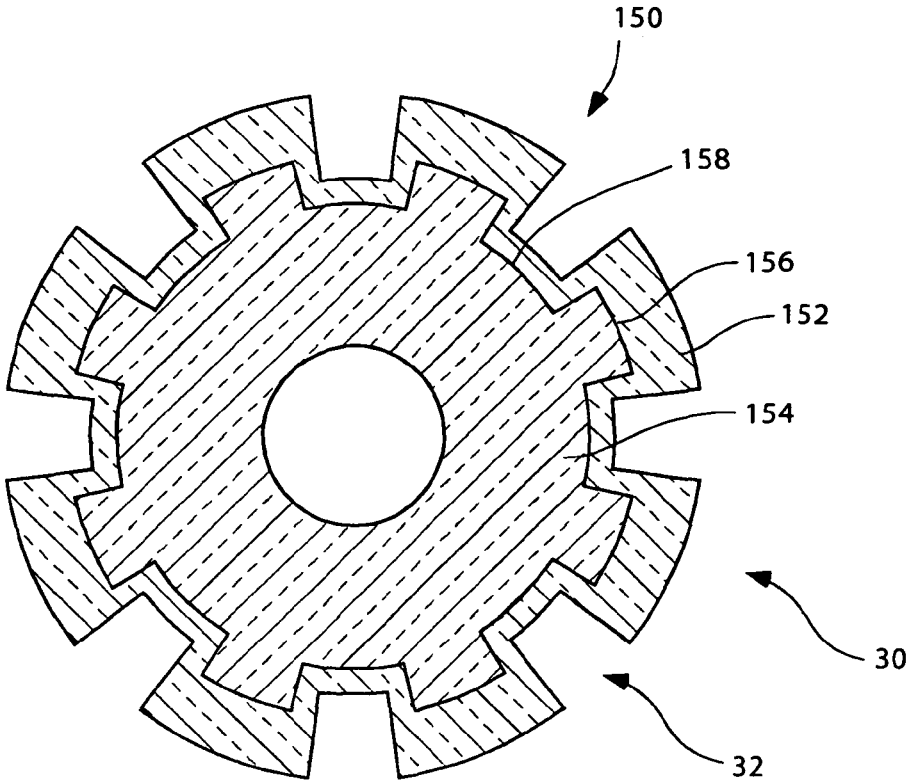
FIG. 10 is a cross-sectional view of the bit body shown in FIG. 9 taken along section line 10-10 shown therein.

FIG. 9 illustrates an additional bit body 150 that embodies teachings of the present invention. The bit body 150 includes a first region 152 and a second region 154. As best seen in the cross-sectional view of the bit body 150 shown in FIG. 10, the interface between the first region 152 and the second region 154 may generally follow the topography of the exterior surface of the first region 152. For example, the interface may include a plurality of longitudinally extending ridges 156 and depressions 158 corresponding to the blades 30 and junk slots 32 that may be provided on and in the exterior surface of the bit body 150. In such a configuration, blades 30 on the bit body 150 may be less susceptible to fracture when a torque is applied to a drill bit comprising the bit body 150 during a drilling operation.

Figure 11:
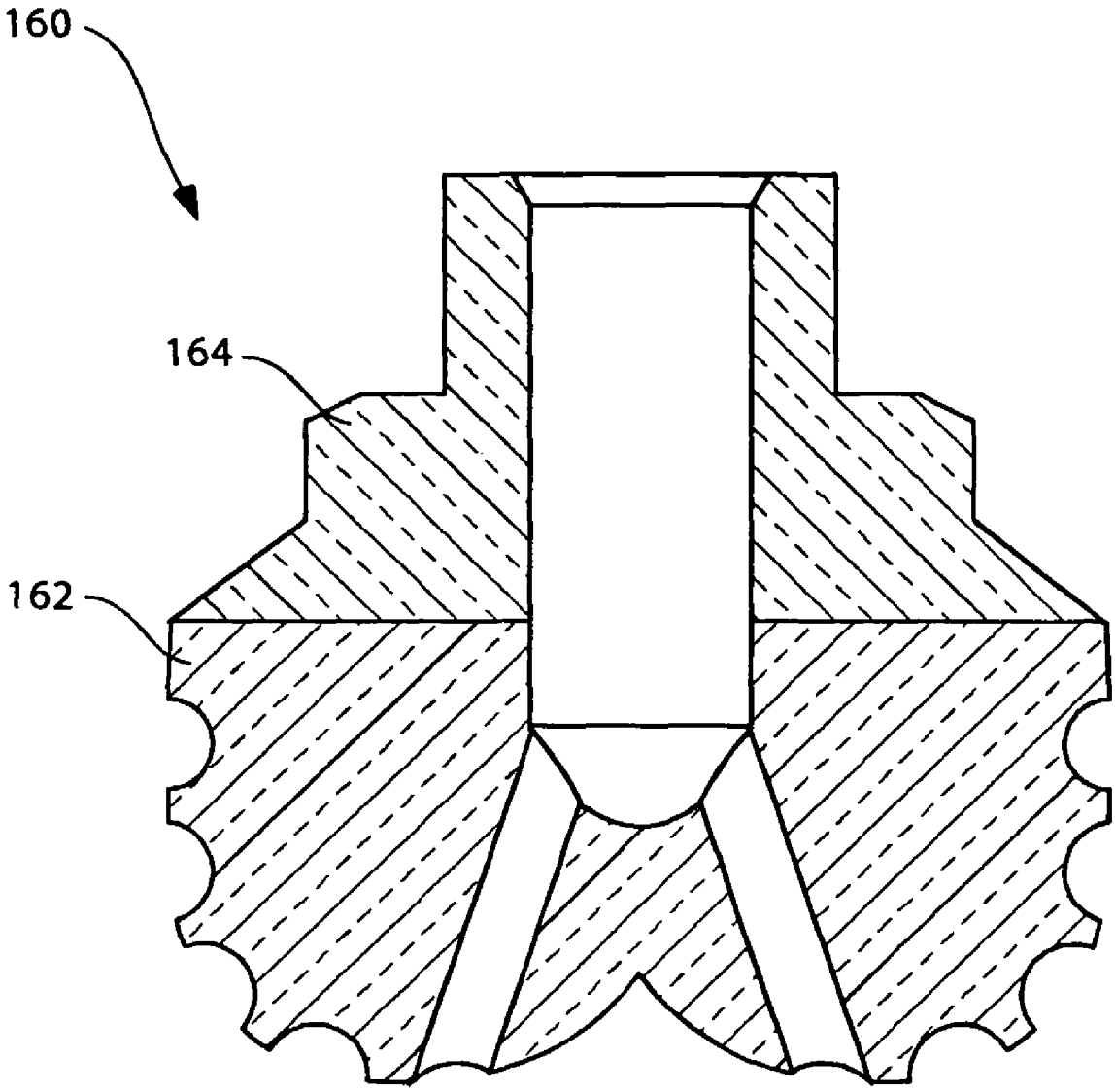
FIG. 11 is a cross-sectional side view of still another bit body that includes a particle-matrix composite material and that embodies teachings of the present invention.

FIG. 11 illustrates yet another bit body 160 that embodies teachings of the present invention. The bit body 160 also includes a first region 162 and a second region 164. The first region 162 may include a longitudinally lower region of the bit body 160, and the second region 164 may include a longitudinally upper region of the bit body 160. Furthermore, the interface between the first region 162 and the second region 164 may include a plurality of radially extending ridges and depressions (not shown), which may make the bit body 160 less susceptible to fracture along the interface when a torque is applied to a drill bit comprising the bit body 160 during a drilling operation.

While teachings of the present invention are described herein in relation to embodiments of concentric earth-boring rotary drill bits that include fixed cutters, other types of earth-boring drilling tools such as, for example, core bits, eccentric bits, bicenter bits, reamers, mills, drag bits, roller cone bits, and other such structures known in the art may embody teachings of the present invention and may be formed by methods that embody teachings of the present invention. Thus, as employed herein, the term "bits" includes and encompasses all of the foregoing structures.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutter types.

What is claimed is:

1. A rotary drill bit for drilling subterranean formations, the rotary drill bit comprising:

a bit body including a crown region predominantly comprised of a particle-matrix composite material, the particle-matrix composite material comprising a plurality of boron carbide particles dispersed throughout an aluminum-based alloy matrix material comprising:

at least 75% by weight aluminum;

at least 3.5% by weight copper; and at least trace amounts of at least one of iron, lithium, magnesium, manganese, nickel, scandium, silicon, tin, zirconium, and zinc; and at least one cutting structure disposed on a face of the bit body;

wherein the plurality of boron carbide particles comprises between about 40% and about 60% by weight of the particle-matrix composite material, and wherein the aluminum-based alloy matrix material comprises between about 60% and about 40% by weight of the particle-matrix composite material; and wherein the plurality of boron carbide particles includes a multi-modal particle size distribution.

2. The rotary drill bit of claim 1, wherein the crown region of the bit body comprises a plurality of blades, the at least one cutting structure being disposed on at least one blade of the plurality of blades.

3. The rotary drill bit of claim 1, wherein the bit body further includes a blank at least partially embedded in the particle-matrix composite material, the blank comprising a metal or metal alloy material and including at least one surface configured for attaching the rotary drill bit to a drill string.

4. The rotary drill bit of claim 1, wherein the aluminum-based alloy matrix material of the particle-matrix composite material comprises at least 90% by weight aluminum.

5. The rotary drill bit of claim 4, wherein the aluminum-based alloy matrix material of the particle-matrix composite material comprises a solid solution.

6. The rotary drill bit of claim 5, wherein the aluminum-based alloy matrix material of the particle-matrix composite material further includes regions comprising at least one precipitate phase dispersed through the solid solution.

7. The rotary drill bit of claim 6, wherein the at least one precipitate phase comprises a metastable phase.

8. The rotary drill bit of claim 7, wherein the at least one precipitate phase comprises an intermetallic compound.

9. The rotary drill bit of claim 8, wherein the intermetallic compound comprises $CuAl_2$.

10. The rotary drill bit of claim 1, wherein the plurality of boron carbide particles comprises a plurality of −20 ASTM Mesh boron carbide particles.

11. The rotary drill bit of claim 1, wherein the at least one cutting structure comprises a plurality of polycrystalline diamond compact cutters disposed on the face of the bit body.

12. A rotary drill bit for drilling subterranean formations, the rotary drill bit comprising:

a bit body including a crown region predominantly comprised of a particle-matrix composite material, the particle-matrix composite material comprising:

a precipitation-hardened matrix material including at least 75% by weight aluminum and at least 3.5% by weight copper, the precipitation-hardened matrix material comprising:

a continuous phase comprising a solid solution, the solid solution comprising copper solute in aluminum solvent; and a discontinuous phase comprising a plurality of discrete regions or particles dispersed through the continuous phase, the discontinuous phase comprising a precipitate phase comprising $CuAl_2$; and a plurality of boron carbide particles dispersed substantially throughout the precipitation-hardened matrix material, the plurality of boron carbide particles including a multi-modal particle size distribution;

wherein the plurality of boron carbide particles comprises between about 40% and about 60% by weight of the particle-matrix composite material, and wherein the precipitation-hardened matrix material comprises between about 60% and about 40% by weight of the particle-matrix composite material; and at least one cutting structure disposed on a face of the bit body.

13. The rotary drill bit of claim 12, wherein the crown region of the bit body comprises a plurality of blades, the at least one cutting structure being disposed on at least one blade of the plurality of blades.

14. The rotary drill bit of claim 12, wherein the bit body further includes a blank at least partially embedded in the particle-matrix composite material, the blank comprising a metal or metal alloy material and including at least one surface configured for attaching the rotary drill bit to a drill string.

15. The rotary drill bit of claim 12, wherein the precipitation-hardened matrix material of the particle-matrix composite material comprises at least 90% by weight aluminum.

16. The rotary drill bit of claim 12, wherein the precipitate phase is metastable.

17. The rotary drill bit of claim 12, wherein the plurality of boron carbide particles comprises a plurality of −20 ASTM Mesh boron carbide particles.

18. The rotary drill bit of claim 12, wherein the at least one cutting structure comprises a plurality of polycrystalline diamond compact cutters disposed on the face of the bit body.

* * * * *